US008683939B2

(12) United States Patent
Spaargaren

(10) Patent No.: US 8,683,939 B2
(45) Date of Patent: Apr. 1, 2014

(54) BOOKMARK WITH MAGNETIC CLIP AND RELEASABLE PAGE HOLDER

(75) Inventor: Jerome Spaargaren, London (GB)

(73) Assignee: EIP Limited, London (GB)

( * ) Notice: Subject to any disclaimer, the term of this patent is extended or adjusted under 35 U.S.C. 154(b) by 89 days.

(21) Appl. No.: 13/239,686

(22) Filed: Sep. 22, 2011

(65) Prior Publication Data

US 2012/0031322 A1 Feb. 9, 2012

Related U.S. Application Data

(63) Continuation of application No. PCT/EP2010/053788, filed on Mar. 23, 2010.

(30) Foreign Application Priority Data

Mar. 23, 2009 (GB) ..... 0904961.0
Apr. 20, 2009 (GB) ..... 0906655.6
Nov. 13, 2009 (GB) ..... 0919911.8

(51) Int. Cl.
*B42D 9/00* (2006.01)

(52) U.S. Cl.
USPC ..... 116/237

(58) Field of Classification Search
USPC ..... 116/234–239
See application file for complete search history.

(56) References Cited

U.S. PATENT DOCUMENTS 1,150,678 A * 8/1915 Heazlewood ..... 281/42
1,469,163 A * 9/1923 Mallina ..... 281/42
1,646,291 A * 10/1927 Horacek ..... 281/42
2,005,559 A 6/1935 Roberts
2,437,074 A * 3/1948 Chapin ..... 116/237
2,449,211 A * 9/1948 Forsyth ..... 116/237

(Continued)

FOREIGN PATENT DOCUMENTS

CA 2231036 A1 11/1999
DE 617719 8/1935

(Continued)

OTHER PUBLICATIONS

WO 03/059642 A2 Benkherouf, Yazid.*

(Continued)

*Primary Examiner* — Randy W Gibson
*Assistant Examiner* — Natalie Huls
(74) *Attorney, Agent, or Firm* — EIP US LLP

(57) ABSTRACT

A bookmark for marking pages in a book includes a laminar element for insertion between laminar book parts. A magnetic clip provides attractive clipping force through a laminar book part for gripping the laminar book part. A hinge part defines at least one abutment area in which the hinge part abuts the laminar book part. A releasable page holder includes a flexible element and a page retaining element, the flexible element being attached, at a first end, to the laminar element and, at a second end, to the page retaining element. The first end is located adjacent an edge of the laminar book part and extends from the first end along an edge of the laminar book part, and the second end is movable with respect to the first end by means of flexing of the flexible element away from the laminar book part towards the second end of the elongate flexible element, to enable the page retaining element to engage and retain the page whilst the bookmark is held in place on the laminar book part by the magnetic clip.

33 Claims, 14 Drawing Sheets

(56) References Cited

U.S. PATENT DOCUMENTS

| | | | | | |
|---|---|---|---|---|---|
| 2,778,331 | A * | 1/1957 | Solis Bonilla | 116/234 |
| 3,158,131 | A * | 11/1964 | Salayka | 116/237 |
| 4,487,156 | A * | 12/1984 | Frost | 116/239 |
| 4,721,057 | A * | 1/1988 | Vigil | 116/238 |
| 4,793,632 | A * | 12/1988 | Hoffman, Jr. | 281/42 |
| 4,813,370 | A * | 3/1989 | Capamaggio | 116/237 |
| 4,838,198 | A * | 6/1989 | Knox | 116/239 |
| 4,928,621 | A * | 5/1990 | Capamaggio | 116/234 |
| 4,932,351 | A * | 6/1990 | Capamaggio | 116/237 |
| 4,941,684 | A * | 7/1990 | Frank et al. | 281/42 |
| 5,103,756 | A * | 4/1992 | Korkames | 116/234 |
| 5,286,060 | A | 2/1994 | Rivera | |
| 7,055,861 | B1 * | 6/2006 | Lee | 281/42 |
| 7,066,494 | B1 * | 6/2006 | Di Prinzio | 281/42 |
| 7,578,257 | B1 * | 8/2009 | Capamaggio et al. | 116/237 |
| 2004/0074436 | A1 * | 4/2004 | Wu | 116/234 |
| 2006/0283371 | A1 * | 12/2006 | Faskowicz | 116/234 |
| 2011/0220008 | A1 * | 9/2011 | Kamiya | 116/237 |

FOREIGN PATENT DOCUMENTS

| | | | | |
|---|---|---|---|---|
| EP | 0061355 | A1 | 9/1982 | |
| EP | 1609620 | A1 * | 12/2005 | B42F 21/06 |
| GB | 07312 | | 0/1903 | |
| GB | 1032569 | A | 6/1966 | |
| GB | 2345265 | A | 7/2000 | |
| JP | 8252992 | | 10/1996 | |
| JP | 2000-238464 | | 9/2000 | |
| JP | 2003266971 | | 9/2003 | |
| JP | 2008068631 | A | 3/2008 | |
| WO | 03059642 | A2 | 7/2003 | |
| WO | 2006021795 | A2 | 3/2006 | |

OTHER PUBLICATIONS

Patent Act 1977: Examination Report under Section 18(3) mailed Feb. 12, 2013, GB Application No. GB1004826.2, 4 pages.

Patent Act 1977: Combined Search and Examination Report under Sections 17 and 18(3) mailed Feb. 13, 2013, GB Application No. GB1300077.3, 7 pages.

* cited by examiner

VIEW B-B

BOOKMARK WITH MAGNETIC CLIP AND RELEASABLE PAGE HOLDER

FIELD OF THE INVENTION

The present invention relates to a bookmark for marking a page in a book. More specifically, but not exclusively, the present invention relates to an automated bookmark that marks successive pages of the book during reading.

BACKGROUND OF THE INVENTION

The most basic form of a bookmark comprises a single elongate laminar element, cut from a sheet, which can easily be inserted in and removed from a book. Such a bookmark is popular because it is cheap to make, can be made decorative and easy to use. However, the reader has to remove the bookmark when reading and to re-insert the bookmark to mark his most recently read page, and, if he closes the book before moving the bookmark in this manner he loses the most recently read page. Thus successful use of such a bookmark requires some co-ordination and organization by the user.

Many different types of more complex bookmarks have been developed, and these generally comprise a number of working parts which have to be made separately and fitted together during manufacture; a useful review thereof is provided in U.S. Pat. No. 4,941,684. A problem with these, and the bookmark forming the subject of this United States patent, is that they are complicated to manufacture and use, expensive to manufacture and are bulky and not particularly easy to carry around when not in use.

There are many bookmarks which include some form of clip which is used to retain a page or set of pages—the clip must be removed and then clipped back to a different position when the marker is to be moved. An example is U.S. Pat. No. 6,015,166, which describes various forms of clips. The pages cannot be turned normally whilst the clip is attached to the page currently being read.

There are also automated bookmarks, which do not need to be moved by the user when the bookmark is used. The bookmarks include a page retaining element which has a movement which allows a page to be turned normally, with the page retaining element lifting up and then being rotated away from the current page, thereby to release the page retaining element and then reposition it on the next page. An example is shown in U.S. Pat. No. 4,793,632; this is a complex mechanical design which is expensive to manufacture and bulky.

In some cases, the bookmark is designed to allow pages to be slipped out from under a clip. An example of this is U.S. Pat. No. 4,932,351. This patent includes two different embodiments. In one embodiment the bookmark includes a metal wire acting as a page retainer clip attached to a metal book cover clip, and this is currently produced for sale as a product called the "Pagekeeper". In another described embodiment, the bookmark may be formed from a one-piece molded plastic element. A problem with this prior art is that the page must be turned by a user in a given way—it must be turned in such a way as to allow the page to be slipped out from underneath the page retainer clip. Any other kind of turning is likely to damage the page being turned. Also, where the bookmark is formed of molded plastic rather than of metal, the design does not have a workable operation—in particular, the page retainer clip lacks robustness. Furthermore, when the book cover clip is made in the same plastic molding as the page retainer clip, if the plastics material is sufficiently flexible to allow the page retainer clip to be moved to a page being read, the book cover clip lacks grip whilst if the plastics material is sufficiently rigid to provide the book cover clip with grip, the page retainer clip is insufficiently flexible to be moved to a page being read.

Another automated bookmark is shown in European patent EP0816121, also known as a product called the "Automark". This bookmark is cut out from a single laminar element, and is therefore relatively inexpensive to manufacture. However, the bookmark suffers from a number of disadvantages:

a) it lacks robustness since the arm which attaches the page retaining element to the remainder of the bookmark is deliberately narrowed to enhance the flipping motion of the page retaining element.

b) it is somewhat difficult to position in a book; the positioning is not intuitive, which makes it difficult for normal users to use properly.

c) it does not work particularly well with thick sets of pages, as the page retaining element tends to slip out from the current page.

PCT/GB2005/003325 describes an automated bookmark, which is formed as a laminar element. An arrangement of such a bookmark is shown in FIGS. 1*a* and 1*b* and FIGS. 2*a* and 2*b* of this specification. The bookmark 1 is suitable for use in a book having a spine 3 and a plurality of rectangular pages 5*a*, 5*b*, 5*c*, 5*d*, each page having a top 7, a bottom 9, a free side edge 11, and an attached side edge 13 attached at the spine of the book 3. FIGS. 1*a* and 1*b* show an embodiment of the bookmark 1 in use, engaging with different pages of the book (holding more pages in FIG. 1*b* than are held in FIG. 1*a*).

Referring to FIGS. 2*a* and 2*b*, the known bookmark comprises an anchor 18, an arm 17 and page retaining element 19 attached thereto, the anchor 18 having locating means for positioning the bookmark with respect to the book in a preferred configuration which is determined by the construction of the locating means. The locating means is provided by a side 15 of the bookmark, which is arranged to face the spine 3 of the book or of a page therein so as to locate the bookmark, by a holding force provided by the spine 3 of the book, with respect to the book in the preferred configuration.

The page retaining element 19 comprises a page retaining edge 19*a* that is arranged to engage the top 7 (or bottom 9) of a page, thereby retaining the page in the back of the book when the book is opened. When the side 15 of the bookmark abuts the spine 3 of the book, at least a portion of the page retaining edge 19*a* is arranged to make at an angle with the top of the retained page. The angle is such that when the retained page is turned, in order to reveal a next page in the book, the retained page is released and the page retaining edge engages with the next page. Referring specifically to FIG. 2*b*, this type of bookmark does not work particularly well with thick sets of pages, as the page retaining element tends to slip out from the current page.

Thus in summary there are problems which the applicant has identified with respect to the prior art automated bookmarks which are formed as a laminar element. One is that when it is placed in a closed book the pages either side of the page retaining element tend to splay from each other due to the angling of the arm and the page retaining element, and this effect becomes greater the greater the number of pages being held is. Furthermore, the bookmarks only work with a relatively small number of pages gripped therein and a bookmark may need to be moved to different positions in the book several times during reading, since once the page retaining element is disposed on a page relatively remotely from the anchor the page retaining element tends to twist away from the page. The page retaining element tends to slide off the marked page, which is an effect which is desired during releasing of the page being turned but which is detrimental when the bookmark is in its normal page marking state. In essence, the prior art automated bookmarks were either elaborate mechanical devices or did not tend to work well with thick sets of pages, or indeed whole books which are relatively thick.

It would be desirable to provide an automated bookmark that is more effective than prior art automated bookmarks. It would also be desirable to provide an automated bookmark which is relatively simple and inexpensive to manufacture and particularly convenient to use.

SUMMARY OF THE INVENTION

According to a first aspect of the present invention there is provided a bookmark for marking pages in a book having a spine and a plurality of laminar book parts attached to the spine, the laminar book parts including front and back covers and a plurality of pages, each laminar book part being planar and having edges including a top, a bottom, a free side edge, and an attached side edge attached at the spine of the book, the bookmark comprising:

a laminar element for insertion between laminar book parts;

a magnetic clip which provides attractive clipping force through a laminar book part for gripping the laminar book part, abutment means; and a releasable page holder, the abutment means being arranged to define at least one abutment area in which the abutment means are adapted to abut against the laminar book part, the at least one abutment area defining a line of abutment along which an edge of the laminar book part is to be aligned when the abutment means is abutted against the laminar book part, the releasable page holder comprising a flexible element and a page retaining element, the flexible element being attached, at a first end, to the laminar element and, at a second end, to the page retaining element, wherein the first end of the flexible element is arranged to be located adjacent an edge of the laminar book part and the flexible element is arranged to extend from the first end along an edge of the laminar book part when the abutment means is abutted against an edge of the laminar book part, and wherein the second end of the flexible element is arranged to be movable with respect to the first end by means of flexing of the flexible element away from the laminar book part towards the second end of the elongate flexible element, to enable the page retaining element to engage and retain the page whilst the bookmark is held in place on the laminar book part by the magnetic clip.

Accordingly, this aspect of the present invention provides an automated bookmark having a convenient and reliable clip. The abutment means can abut the book in one or two places, and places the bookmark in the preferred configuration, and the flexible element is arranged so that the page retaining element is positioned on the page in the correct manner in the preferred configuration whilst the magnetic clip releasably holds the bookmark in place.

In a first arrangement the at least one abutment area is arranged, along the line of abutment, to one side of the flexible element. At least two suitable configurations are possible for this arrangement: a first in which the at least one abutment area is arranged relatively close to the first end of the flexible element, and relatively far from the second end of the flexible element, and a second in which the abutment area is arranged relatively close to the second end of the flexible element, and relatively far from the first end of the flexible element. In either configuration the at least one abutment area comprises a single abutment area having a total width of between 2 cm and 7 cm, preferably between 3 cm and 6 cm and most preferably of between 4 cm and 5 cm.

As regards the first configuration, namely that in which the abutment area is arranged proximate the second end of the page retaining element, the clip parts can be relatively simple in construction and are readily accessible to the user. This latter advantage results from the fact that it the abutment area can be located relatively close to the free edge of the book cover, meaning that it is easier to operate the clip parts using the hands than when the clip parts are closer to the book spine (where the pages are more closely bunched together and space is more limited.) Also, when the bookmark is correctly placed, and the page retaining element is placed within a book, any movement of the pages is reduced, relative to the page retaining element, than would be the case if the page retaining element were located closer to the spine. As will be appreciated, the free edges of the pages move more than do the edges of the pages attached to the spine (which by virtue of their attachment to the spine do not move at all in the book); thus any means of reducing the movement of the free pages makes the bookmark more reliable than it otherwise would be.

As regards the second configuration, namely that in which the abutment area is arranged proximate the first end of the page retaining element, and thus closer to the spine of a book, the clip parts are readily positionable since the spine of the book provides a natural stop against which the bookmark can be readily located. Further, if the abutment means is arranged on the side of the spine, it may be easier for the user to place the bookmark correctly in the book, providing they do not have any problems opening the book sufficiently for the clip to be placed near to the spine. In addition, the second clip part of the clip parts (namely that located on the outside of the book, when in use) is located further away from the user's fingers when holding the book during reading; this reduces the interference of the bookmark to the correct and comfortable holding of the book during reading.

In a further arrangement the at least one abutment area comprises two abutment areas each arranged, along the line of abutment, to different respective sides of the flexible element. One advantage of this arrangement is that the length of the abutment means, along the line of abutment, is effectively increased to a length greater than the width of the flexible element itself, so that correct positioning of the bookmark (e.g. aligning the abutment means correctly along the top of the back cover) is relatively easy. The arrangement provides two, relatively widely, spaced, points of reference for the easy correct positioning of the bookmark, e.g. on the back cover of the book.

A particular advantage can be gained when the bookmark is used to mark a page of a paperback book: in use one of the clip parts can be located on the outside of the back cover of the book and thus provides a convenient medium for the printing or affixing of graphical images, signs, patterns and the like.

In particularly preferred embodiments of the invention the magnetic clip comprise a pair of magnetic members, or magnetic elements, each affixed to a respective substrate part.

The magnetic clip advantageously provides a means of fixedly and releasably attaching the bookmark to a selected book part and relieve the need for the bookmark to locate against the spine of the book in order to perform correct positioning. In one arrangement the magnetic clip includes a pair of clip parts which are mutually attached via the abutment means, which can comprise a hinge part, configured such that each of the magnetic elements is located either side of the hinge part. Preferably the hinge part comprises a folded part so that the clip parts can be formed from a single sheet piece of cut sheet material. More preferably the folded part is located between two parallel folds formed in an underside of the sheet material such that, in a fully folded position, the first clip part is parallel to, and spaced apart from, the second clip part. The first and second clip parts are spaced apart by a distance directly dependent on the distance between the two folds; this distance is preferably between 1 mm and 5 mm, more preferably between 2 mm and 4 mm and most preferably 3 mm.

The magnetic clip preferably comprises a matched magnetic pair in the form of magnetic strips, of respective opposite magnetisations (e.g. A Type and B Type magnetisations). The magnetic strips may be adhered to respective substrate parts of the bookmark using a suitable adhesive bonding material. The magnetic strips may for example be formed from magnetic rubber or magnetic plastic (i.e. magnetic powder supported in a rubber or plastic substrate.) Preferably, the magnetic strips have length and width dimensions, parallel to the clipping plane, of at least 1 cm×1 cm and more preferably, at least 2 cm×2 cm, in order to provide sufficient clipping force through the cover of a book whilst securely clamping the bookmark in its correct position, even during use and, in particular during flexing of the flexible element during turning of the pages. Further, the thickness of each of the magnetic strips is preferably at least 0.7 mm; more preferably 1 mm or more and most preferably approximately 1.5 mm; again, this is to provide sufficient clipping force through the cover of a book whilst securely clamping the bookmark in its correct position, even during use and, in particular during flexing of the flexible element during turning of the pages.

Preferably, the abutment line has a first side and a second side, the flexible element being arranged on the second side of the line of abutment and the page retaining element being arranged on the first side of the line of abutment, the flexible element including an inner edge, which is relatively close to the line of abutment, and an outer edge, which is relatively far from the line of abutment, the first and second ends of the flexible element being separated with respect to each other along the line of abutment by an end separation distance of at least 1 cm. The end separation distance of the flexible element is preferably at least 3 cm and less than 9 cm, more preferably between 4 cm and 8 cm and most preferably between 5 cm and 7 cm. The page retaining element preferably extends from the line of abutment by an extension distance of between 1 cm and 3 cm; most preferably the extension distance is 2 cm.

The bookmark is preferably formed from cut and folded sheet material, and the bookmark can be formed from a single-sheet cut and folded blank to which said magnetic elements may be applied. The flexible element is preferably an elongate, rounded element, and the page retaining element is preferably an elongate element. In terms of preferred dimensions of the page retaining element the average width, measured parallel to the line of abutment, of the page retaining element is less than 1.5 cm, and its maximum width is less than 1.5 cm; preferably the average width is less than 1 cm.

The flexible element is preferably arranged so that the maximum vertical distance between the inner edge of the is flexible element and the line of abutment is preferably less than 2 cm and at least 3 mm; most preferably the distance is between 5 mm and 1.5 cm. This means that the moment imparted to the flexible element when the page is turned in use is sufficient to cause the flexible element to twist and thereby allow the page to be released readily when turned.

The average width of the flexible element is preferably less than 1.5 cm. This allows the flexible element to be flexed relatively easily by turning the page in use. Preferably the average width of the flexible element, averaged along the extent of the separation distance, is more than approximately 5 mm, to provide the flexible element with sufficient robustness in use. Further, the thickness of the flexible element, measured perpendicular to the line of abutment, is less than 1.5 mm, preferably less than 1 mm.

In preferred embodiments the page retaining element comprises a page retaining edge, facing the first end of the flexible element, at least part of which is angled such that an angle between said part of the edge and the line of abutment is less than 90°, when measured from the side of the first end of the flexible element. More preferably the angle is between 60° and 80°; arranging for the angle between the page retaining edge and the line of abutment, or edge-of-page line, to be less than 90° means that when the bookmark is inserted into a relatively thick book, so that the page retaining element is positioned relatively far from the abutment means, the page retaining edge does not excessively lift up from the page of the book; i.e. the effect of the free end of the page retaining element lifting up from the page, due to the fact that the flexible element of the bookmark twists, is reduced.

Preferably, the angling of the page retaining edge is selected such that the effect of free end of the page retaining element lifting up from the page of the book is substantially compensated by the angling of the page retaining edge. More preferably, the compensation effect is such that the free end of the page retaining element is preferably located within 2 mm of the page of the book when a 1 cm thickness of pages is held within the bookmark. Even more preferably, the compensation effect is such that the free end of the page retaining element is preferably located within 2 mm of the page of the book when a 2 cm thickness of pages is held within the bookmark. More preferably, the free end is within 1 mm of the page in each of these configurations. The exact angle which the page retaining edge should take will depend on the exact material and configuration of the flexible element, but generally the preferred angle is between 55° and 85°; more preferably the angle is between 60° and 80°; most preferably the angle is between 65° and 78°.

This angling of the force-receiving edge assists the force-receiving edge of the page retaining element to translate horizontal force into vertical force, so that the act of releasing the page retaining element is facilitated. This effect is especially important for a flexible element formed from sheet material, since it is preferable to cause the flexible element to twist in order to release the page which is being held. Thus, the force-receiving edge imparts a force having a vertical component which causes the flexible element to twist.

Furthermore, this angling means that the force-receiving edge of the page retaining element does not extend significantly above the surface of the page when the bookmark is in its preferred configuration.

Conveniently the page retaining edge is shaped such that a variable angle is provided between the page retaining edge and the line of abutment along a length of the page retaining edge, said variable angle decreasing, when measured from the side of the first end of the flexible element, as the page retaining edge extends away from the line of abutment.

As regards overall dimensions of the bookmark, the width of said bookmark, measured parallel to the line of abutment, is within a range of between 7 cm and 16 cm, preferably between 9 cm and 13 cm, and most preferably between 10 cm and 12 cm. These dimensions allow the bookmark to be used in a range of paperback books, some of which typically have a width of 13 cm or less, without the bookmark protruding from the side of the book.

According to a further aspect of the invention there is provided a bookmark comprising:

a clip for holding the bookmark on a book part;

abutment means; and a releasable page holder, the abutment means being arranged to define at least one abutment area in which the abutment means are adapted to abut against a book part, the at least one abutment area defining a line of abutment along which the book part is to be aligned when the book part is abutted against the abutment means, the abutment line having a first side and a second side, the clip parts being arranged on the first side of the line of abutment, and the releasable page holder comprising a flexible element and a page retaining element, the flexible element being arranged on the second side of the line of abutment and the page retaining element being arranged on the first side of the line of abutment, the flexible element being formed as a sheet-like element including an inner edge, which is relatively close to the line of abutment, and an outer edge, which is relatively far from the line of abutment, the flexible element being attached, at a first end, to the bookmark and, at a second end, to the page retaining element, the second end of the flexible element being movable with respect to the first end by means of flexing of the flexible element, wherein the first and second ends of the flexible element are separated with respect to each other along the line of abutment by an end separation distance of at least 1 cm, wherein the flexible element has an average width, measured perpendicular to the line of abutment and averaged along the extent of said end separation distance, of at least 0.3 cm, and wherein the page retaining element comprises a page retaining edge, facing the first end of the flexible element, at least part of which is angled such that an angle between said part of the edge and the line of abutment is less than 90°, when measured from the side of the first end of the flexible element.

In embodiments of the invention the abutment means and the releasable page holder are formed as a unitary piece from cut and folded sheet material. Accordingly the invention further provides a method of manufacturing an automated bookmark according to the above aspects, said method comprising cutting said bookmark from a laminar substrate.

It has been found that embodiments of bookmark arranged according to this aspect of the present invention can be used to mark at least double, and in some cases at least four times, the number of pages that prior art automatic bookmarks formed from laminar elements can mark, which is a significant gain in effectiveness.

According to a yet further aspect of the present invention there is provided a bookmark for marking pages in a paperback book having a spine, front and back covers and a plurality of pages, each cover and each page being planar and having edges including a top, a bottom, a free side edge, and an attached side edge attached at the spine of the book, the bookmark comprising:

a clip for gripping the back cover of a paperback book, abutment means; and a releasable page holder, the abutment means being arranged to define at least one abutment area in which the abutment means is adapted to abut against a part of the paperback book cover, the at least one abutment area defining a line of abutment along which the paperback book cover is to be aligned when the abutment means is abutted against the paperback book cover, the releasable page holder comprising a flexible element and a page retaining element, the flexible element being attached, at a first end, to the bookmark and, at a second end, to the page retaining element, the second end of the flexible element being movable with respect to the first end by means of flexing of the flexible element in a curve which bends away from the paperback book cover towards the second end of the flexible element, wherein the clip is a magnetic clip which provides attractive clipping force through the back cover of the paperback book.

In some embodiments of the invention, the part of the paperback book cover with which the abutment means aligns is the top edge of the paperback book cover (the book cover having a top edge, a bottom edge and a free side edge); in these embodiments, the magnetic clip may be arranged to be placed over the book cover by putting it into place over the top edge of the paperback book cover. In embodiments of the invention the same, or a similar, arrangement may be used, alternatively, by placing the magnetic clip over the book cover by putting it into place over the bottom edge of the paperback book cover, in which case the part of the paperback book cover with which the abutment means aligns is the bottom edge of the paperback book cover. Yet further, in embodiments of the invention the same, or a similar, arrangement may be used, alternatively, by placing the magnetic clip over a page of a hardback or paperback book by putting it into place over the top or bottom edge of a page, or set of pages, in the book, in which case the part of the book with which the abutment means aligns is the bottom edge of a page, or set of pages, of the book.

In other embodiments of the invention, the part of the paperback book cover with which the abutment means aligns is the free side edge of the paperback book cover (the book cover having a top, a bottom and a free side edge); in these embodiments, the magnetic clip may be arranged to be placed over the book cover by putting it into place over the free side edge of the paperback book cover. Yet further, in embodiments of the invention the same, or a similar, arrangement may be used, alternatively, by placing the magnetic clip over a page of a hardback or paperback book by putting it into place over the free side edge of a page, or set of pages, in the book, in which case the part of the book with which the abutment means aligns is the free side edge of a page, or set of pages, of the book.

By positioning the abutment means in relation to the free side edge of the book cover, or a page (or set of pages), the advantage is achieved that the positioning of the page retaining element with respect to the free side edge is conveniently, and reliably achievable. This positioning may, in some embodiments, assist with the functioning of the bookmark, since the positioning of the page retaining element with respect to the free side edge correctly can assist with the releasing of the page when a page is turned, particularly if the book is relatively large, and therefore the top edge of the page is wide and without such positioning with respect to the free side edge being defined, the bookmark might otherwise be positioned anywhere along the top edge and, if placed too close to the spine of the book, the functioning may not be optimal.

According to a yet further embodiment of the invention there is provided a bookmark comprising:

a pair of clip parts adapted to clip over the back cover of a book such that a first clip part of said pair is located to the front of the back cover and a second clip part of the pair is located to the back of the back cover, the pair of clip parts defining a clipping plane corresponding to a plane of the back cover of the book when the back cover is clipped between said clip parts;

abutment means; and a releasable page holder, the abutment means being arranged to define at least one abutment area in which the abutment means are adapted to abut against a book part, the at least one abutment area defining a line of abutment along which the book part is to be aligned when the book part is abutted against the abutment means, the abutment line having a first side and a second side, the pair of clip parts being arranged on the first side of the line of abutment, the releasable page holder comprising a flexible element and a page retaining element, the flexible element being arranged on the second side of the line of abutment and the page retaining element being arranged on the first side of the line of abutment, the flexible element including an inner edge, which is relatively close to the line of abutment, and an outer edge, which is relatively far from the line of abutment, the flexible element being attached, at a first end, to the bookmark and, at the second end, to the page retaining element, the second end of the flexible element being movable with respect to the first end by means of flexing of the flexible element, wherein the first and second ends of the flexible element are separated with respect to each other along the line of abutment by an end separation distance of at least 1 cm, the flexible element having an average width, measured perpendicular to the line of abutment and parallel to said clipping plane, averaged along the length of the end separation distance, of at least 3 mm, and the first and second clip parts each having lengths, measured perpendicular to the line of abutment and parallel to said clipping plane, which are greater than a maximum separation between the inner edge of the flexible element and the line of abutment.

The first and second clip parts preferably each have lengths, measured perpendicular to the line of abutment and parallel to said clipping plane of at least 2 cm, while the maximum separation between the inner edge of the flexible element and the line of abutment is preferably less than 2 cm.

More preferably, the first and second clip parts preferably each have lengths, measured perpendicular to the line of abutment and parallel to said clipping plane, which are greater than at least twice the maximum separation between the inner edge of the flexible element and the line of abutment. In a particularly advantageous arrangement the first and second clip parts preferably each have lengths of at least 3 cm, while the maximum separation between the inner edge of the flexible element and the line of abutment is preferably less than 1.5 cm.

According to a yet further embodiment of the invention there is provided a bookmark for marking pages in a paperback book having a spine, front and back covers and a plurality of pages, each cover and each page being planar and having edges including a top, a bottom, a free side edge, and an attached side edge attached at the spine of the book, the bookmark comprising:

a laminar element for insertion between the back page and the back cover of a paperback book;

a clip for gripping the back cover of the paperback book, an abutment part; and a releasable page holder, the abutment part being arranged to define at least one abutment area in which the abutment part is adapted to abut against the free side edge of the paperback book cover, the at least one abutment area defining a line of abutment along which the paperback book cover is to be aligned when the abutment part is abutted against the paperback book cover, the releasable page holder comprising an elongate flexible member and a page retaining element, the elongate flexible member being attached, at a first end, to the laminar element and, at a second end, to the page retaining element, the second end of the elongate flexible member being movable with respect to the first end by means of flexing of the elongate flexible member away from the paperback book cover towards the second end of the elongate flexible member, and wherein the first end is arranged to be located adjacent the top edge or the bottom edge of the paperback book cover when the abutment part is abutted against the free side edge of the paperback book cover and the bookmark is correctly positioned in a book, such that the elongate flexible member extends along the top edge or the bottom edge of the paperback book, and the page retaining element may be extended over at least the respective top edge or bottom edge of a page, to engage and retain a page when the bookmark is in use.

Preferably, in embodiments in which the abutment means, which in preferred embodiments associated with the magnetic clip, is arranged to be abutted against a free side edge (of the book cover or a page, or set of pages of the book), the bookmark also includes an alignment edge, marking or other delineation which provides a guide allowing the user to correctly position the bookmark with respect to the top edge of the book cover or a page, or set of pages of the book), or allowing the user to correctly position the bookmark with respect to the bottom edge of the book cover or a page, or set of pages of the book.

Further aspects, features and advantages of the invention will become apparent from the following description of preferred embodiments of the invention, which is given by way of example only.

Figure 1A:
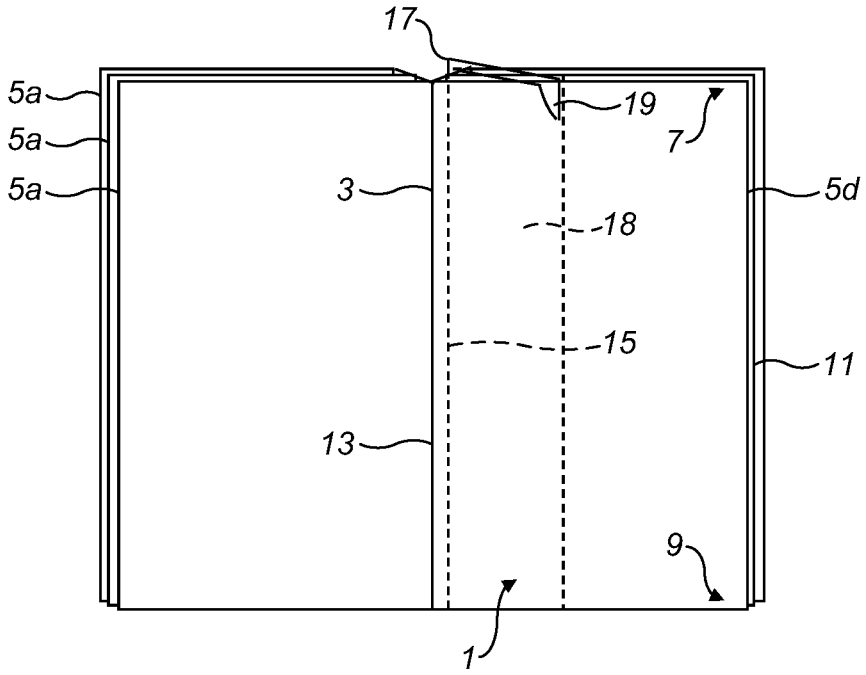
FIG. 1a Prior Art
FIGS. 1*a* and 1*b* are schematic diagrams showing a known bookmark, which is described in PCT/GB2005/003325, in first and second positions in a book.
Figure 1B:
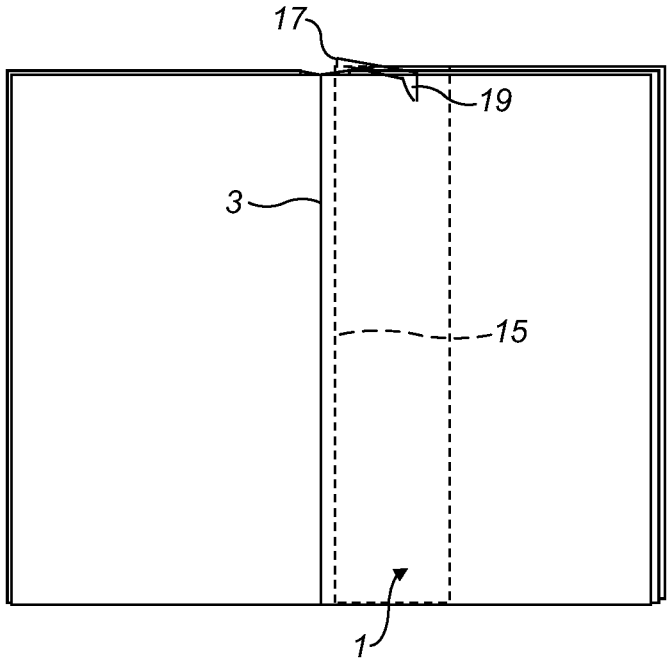
FIG. 1b Prior Art
Figure 2A:
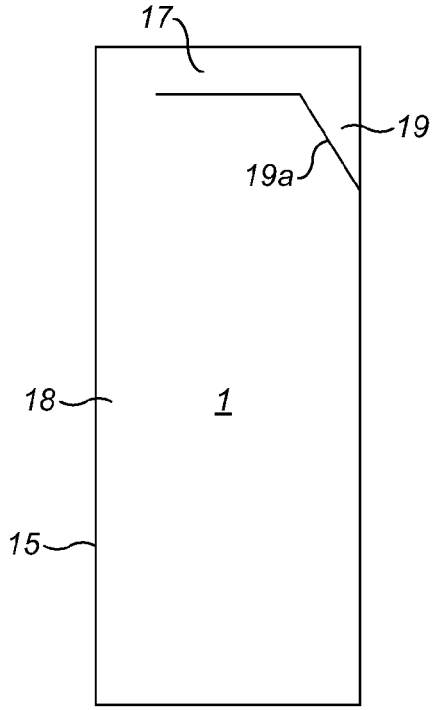
FIG. 2a Prior Art
FIG. 2*a* shows a plan view of the bookmark shown in FIGS. 1*a* and 1*b;*
Figure 2B:
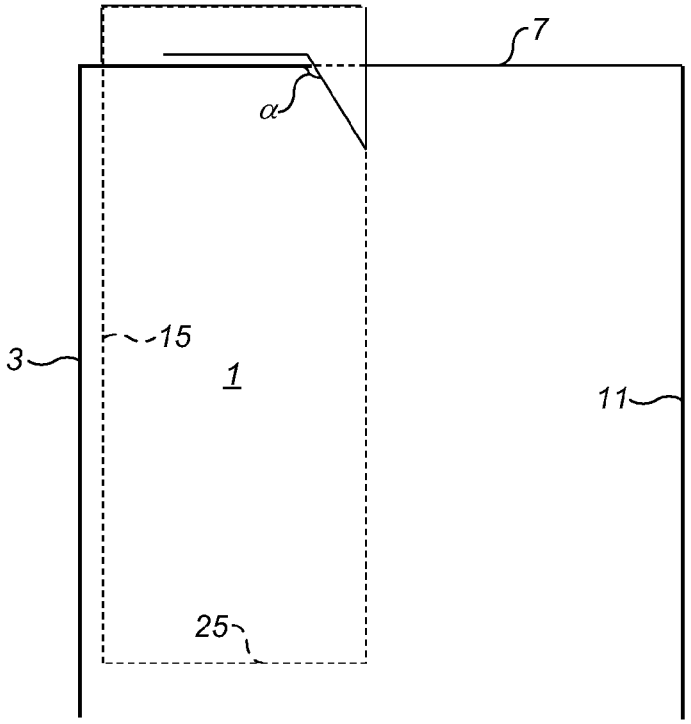
FIG. 2b Prior Art
FIG. 2*b* shows further details of the known bookmark shown in FIG. 2*a;*

In the Figures, the various features of the invention are enumerated and referred to as such in the description of same. The invention is described with reference to several embodiments, each being depicted in a respective figure. For clarity, where a particular feature is common to the various embodiments, the reference numeral assigned to the feature in its first occurrence is used in subsequent figures.

DETAILED DESCRIPTION OF THE INVENTION

In all of the embodiments described below there is provided an automated bookmark for marking a page in a book having a spine, laminar book parts in the form of planar rectangular front and back covers and a plurality of planar rectangular pages. The laminar book parts each have edges including a top, a bottom, a free side edge, and an attached side edge attached at the spine of the book.

Embodiments of the invention are particularly, but not exclusively, designed to be clipped to the top, bottom or free side of the back cover of a paperback book, but can also be clipped to a set of one or more pages within the book, in the case of particularly thick paperback books, or to a set of one or more pages within a hardback book, of which the cover may be too thick for an effective attachment to be achieved. In a particularly advantageous arrangement, the bookmark is designed to be clipped to the top of the back cover of a paperback book, but can also be clipped to pages within a book.

The invention may be embodied in a large number of ways, and in relation to each of the embodiments described below the bookmark may be formed by cutting and punching from a laminar substrate, such as plastic sheet material. The cutting can be performed by die cutting or laser cutting. Other methods of manufacture may also be used, such as injection molding.

Figure 3:
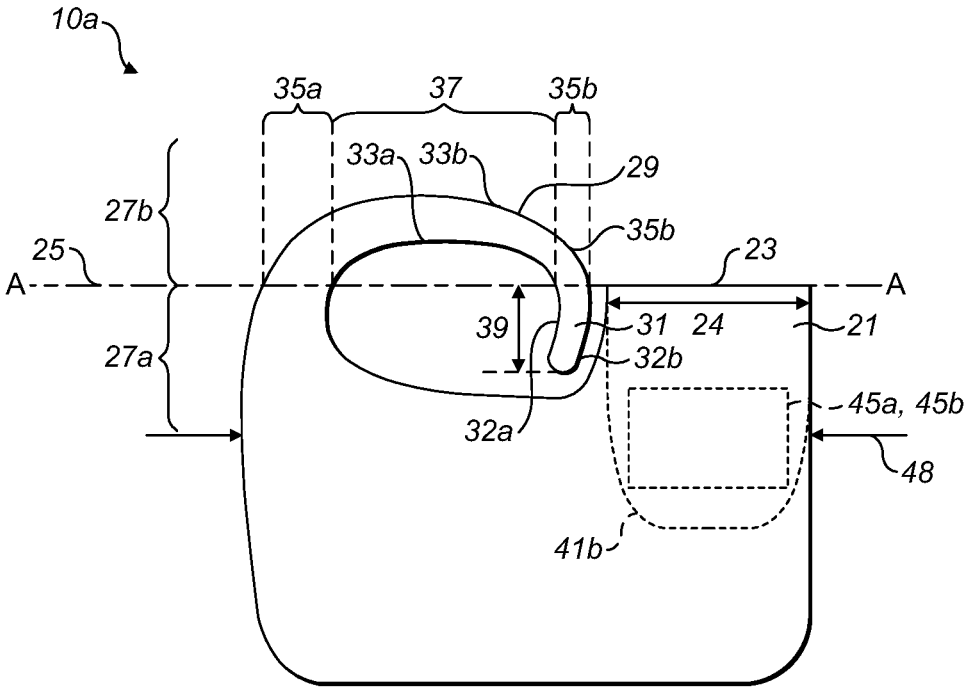
FIG. 3 shows a plan view of a bookmark according to a first embodiment of the invention, in folded form.
Figure 4:
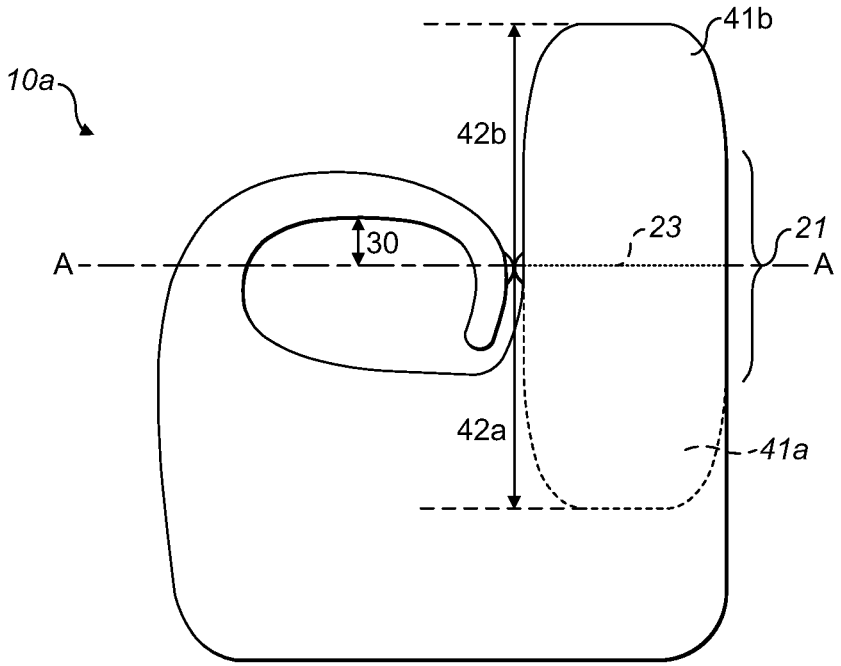
FIG. 4 shows a plan view of a laminar sheet blank cut-out for a bookmark according to the first embodiment of the invention, in unfolded form.

FIG. 3 shows a first embodiment of the bookmark 10*a*, in folded form, while FIG. 4 shows the bookmark 10*a* in unfolded form. As will now be explained, the bookmark 10*a* in this embodiment comprises:

a pair of clip parts 21 adapted to clip over the back cover of a book such that a first clip part 41*a* of said pair is located to the front of the back cover and a second clip part 41*b* of the pair is located to the back of the back cover, the pair of clip parts 21 defining a clipping plane corresponding to a plane of the back cover of the book when the back cover is clipped between said clip parts 41*a*, 41*b;* abutment means 23; and a releasable page holder, the abutment means being arranged to define at least one abutment area 24 in which the abutment means are adapted to abut against a book part, the at least one abutment area 24 defining a line of abutment 25 along which the book part is to be aligned when the book part is abutted against the abutment means 23, the abutment line having a first side 27*a* and a second side 27*b*, the clip parts being arranged on the first side of the line of abutment 25, and the releasable page holder comprising a flexible element in the form of a flexible arm 29 and a page retaining element 31, the flexible arm 29 being arranged on the second side 27*b* of the line of abutment and the page retaining element 31 being arranged on the first 27*a* side of the line of abutment, the flexible arm 29 including an inner edge 33*a*, which is relatively close to the line of abutment 25, and an outer edge 33*b*, which is relatively far from the line of abutment 25, the flexible arm 31 being attached, at a first end 35*a*, to the bookmark and, at the second end 35*b*, to the page retaining element 31, the second end 35*b* of the flexible arm being movable with respect to the first end 35*a* by means of flexing of the flexible arm 31, wherein the first and second ends of the flexible arm are separated with respect to each other along the line of abutment by an end separation distance 37 of at least 1 cm, the flexible arm 29 having an average width, measured perpendicular to the line of abutment 25 and parallel to said clipping plane, averaged along the length of the end separation distance, of at least 3 mm, and the first and second clip parts 41*a*, 41*b* each having lengths 42*a*, 42*b*, measured perpendicular to the line of abutment 25 and parallel to said clipping plane, which are greater than a maximum separation 30 between the inner edge 33*a* of the flexible arm and the line of abutment 25.

The first and second clip parts 41*a*, 41*b* are each laminar elements. Each have lengths measured perpendicular to the line of abutment and parallel to said clipping plane, which are greater than at least twice the maximum separation between the inner edge of the flexible arm and the line of abutment 25. The first and second clip parts 41*a*, 41*b* preferably each have lengths of at least 2 cm, while the maximum separation 30 between the inner edge of the flexible arm and the line of abutment is preferably less than 2 cm. In a particularly advantageous arrangement the first and second clip parts 41*a*, 41*b* preferably each have lengths of at least 3 cm, while the maximum separation 30 between the inner edge of the flexible arm and the line of abutment is preferably less than 1.5 cm. By arranging the first and second clip parts 41*a*, 41*b* to have lengths of at least 3 cm, there is provided an arrangement in which the clip parts can carry magnets which may each have a width, measured along these lengths, of at least 1 cm, and in which the magnets can each be spaced away from the hinge, thereby avoiding strain on the hinge. More preferably, each of the first and second clip parts 41*a*, 41*b* preferably each have lengths of at least 4 cm, although a length of at least 2 cm each may be practicable.

Preferably the first clip part 41*a* has a greater length than the second clip part 41*b* —this provides an arrangement wherein the clip may be readily manually opened—namely the magnetic clip may be readily opened by placing a finger or thumb against the first clip part 41*a*, and engaging end of the second clip part 41*b* with the finger or thumb, a user can readily open the clip. In this arrangement, the first clip part 41*a* preferably has a length of at least 4.5 cm, more preferably at least 6 cm, whist the second clip part preferably has a length of at least 3 cm, more preferably at least 4 cm. In this arrangement, the difference between the lengths of the first and second clip parts 41*a*, 41*b*, the first clip part 41*a* being greater in length than the second clip part 41*b*, is preferably at least 0.5 cm, and more preferably at least 2 cm.

In these arrangements, the magnets are preferably spaced at least 1 cm away from the hinge.

In preferred arrangements the length of the first end 35*a* is less than 3 cm, more preferably less than 2 cm, while the length of the second end 35*b* is preferably less than 1.5 cm, more preferably less than 1 cm.

As can be seen from FIG. 3, the page retaining element 31 comprises a page retaining edge 32*a*, facing the first end 35*a* of the flexible arm; in most embodiments of the invention (other than that shown in FIG. 10), at least part of the page retaining edge 32*a* is angled such that an angle between said part of the edge and the line of abutment 25 is less than 90°, when measured from the side of the first end 35*a* of the flexible arm. Further, in most embodiments of the invention (other than that shown in FIG. 10), the flexible arm 29 is an elongate, rounded element, and the page retaining element 31 is an elongate element. Preferably the average width of the page retaining element 31, when measured along a line parallel to the line of abutment 25, is less than 1 cm. Further, the average thickness of the page retaining element 31, when measured perpendicular to the width, is less than 1.5 mm, preferably less than 1 mm.

Figure 4A:
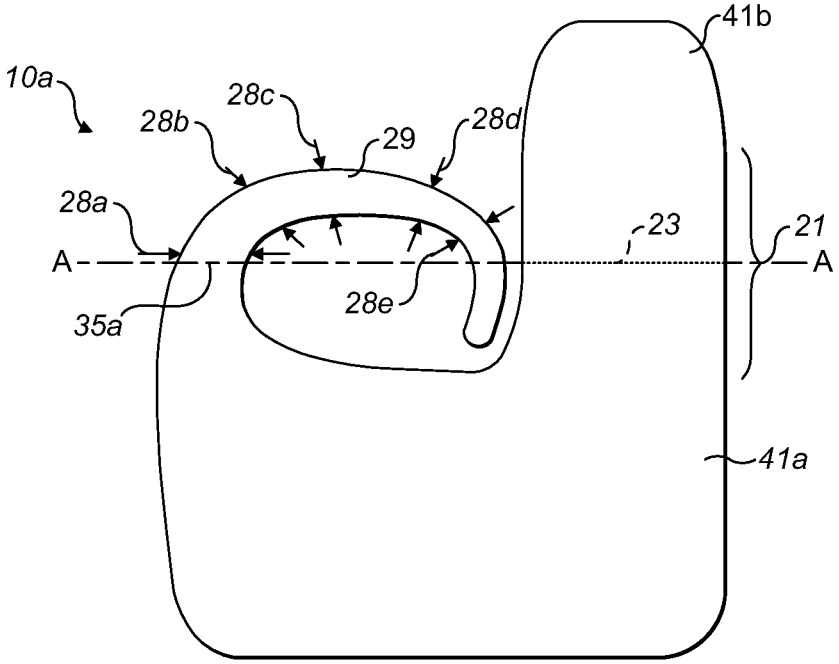
FIG. 4*a* shows a further plan view of a laminar sheet blank cut-out for a bookmark according to the first embodiment of the invention, in unfolded form.

The flexible arm 29 has an average width, measured perpendicular to the line of abutment and parallel to said clipping plane, and averaged along the extent of said end separation distance, of at least 0.3 cm. FIG. 4*a* shows an exemplary configuration of the flexible arm, whereas to illustrate the meaning of average width thereof. As can be seen, at the first end 35*a* of the flexible arm 29, the arm has a thickness 28*a* that is relatively large compared to the thickness 28*e* at the second end 35*b*. Indeed in this embodiment the thickness of the arm effectively tapers along the length of the flexible arm 29, as shown by points 28*a*, 28*b*, 28*c*, 28*d*, 28*e*. In this example the width of the flexible arm 29 at point 28*a* may be 1.3 cm, at point 28*b* 0.9 cm, at point 28*c* 0.8 cm, at point 28*d* 0.6 cm and at point 28*e* 0.5 cm, leading to an average width of approximately 0.8 cm. Other embodiments may scale accordingly, but within the constraint that the average width is 0.3 cm or greater, and more preferably 0.5 cm or greater.

For example, in other embodiments the thickness of the flexible arm 29 varies along its length between the first and second ends 35*a*, 35*b* such that the width of the flexible arm (measured perpendicular to the line of abutment 25), where it meets the first end 35*a*, is approximately 1.5 cm; the width of the flexible arm at the point of maximum separation of the inner edge 33*a* of the flexible arm from the line of abutment 25 (approximately the middle of the flexible arm) is approximately 0.9 cm; the minimum width of the flexible arm 29 from the line of abutment 25 (some distance from the middle of the flexible arm toward the second end 35*b* of the flexible arm) is approximately 0.7 cm; while the width of the flexible arm (measured perpendicular to the line of abutment 25), where it meets the second end 35*b*, is approximately 1.0 cm. As a result the average width of the flexible arm, averaged along the line of abutment, is therefore more than 0.7 cm, and is in fact, in this embodiment, more than 1 cm (and less than 1.2 cm)—in particular approximately 1.1 cm.

In most embodiments of the invention (other than that shown in FIG. 10), the page retaining edge 32*a* is designed to gradually counteract the gradually increasing tilt of the page retaining element 31 caused as the page retaining element is moved further and further from the abutment means 23. This effect is explained in further detail below. In such embodiments of the invention in which the counteracting feature us used, the angle is preferably more than 45° and more preferably more than 55°. Furthermore, the angle is preferably less than 85° and more preferably more than 60°. Most preferably, the angle is between 65° and 78°, approximately. With such an angle, the page retaining edge 32*a* can sit substantially flat against the page, irrespective of the number of pages currently held. Furthermore, in these embodiments the page retaining edge 32*a* is shaped such that a variable angle is provided between the page retaining edge 32*a* and the line of abutment 25 along a length of the page retaining edge, said variable angle decreasing, when measured from the side of the first end of the flexible arm 35*a*, as the page retaining edge extends away from the line of abutment 25.

Note that the predefined line of abutment 25 is consistently denoted in the Figures for various different embodiments by a dotted line A-A. The line of abutment is defined by an abutment area 24, or one or more abutting edges, in each case. In different embodiments of the invention such edges, or area, are embodied as a side edge of the abutment means and/or a lower surface of the arm and/or a hinge part. By means of such abutting edges, or abutment area 24, correct positioning can be achieved simply by positioning with respect to the top 7 of a page or the book cover.

In arrangements in which the line of abutment is defined by an abutment area, comprising a hinge part, the hinge part can be embodied either as a single part, arranged one or another side of the releasable page holder or indeed either side of the releasable page holder. In these arrangements the book cover clip can include a pair of magnetic elements, which, as will be described in detail below are adapted to clip over a book cover; the magnetic elements provide a means of fixedly and releasably attaching the bookmark to the book cover and relieve the need for the bookmark to be located against the spine of the book in order to perform correct positioning. Such arrangements are shown in FIGS. 3-8, to be further described below.

Figure 9:
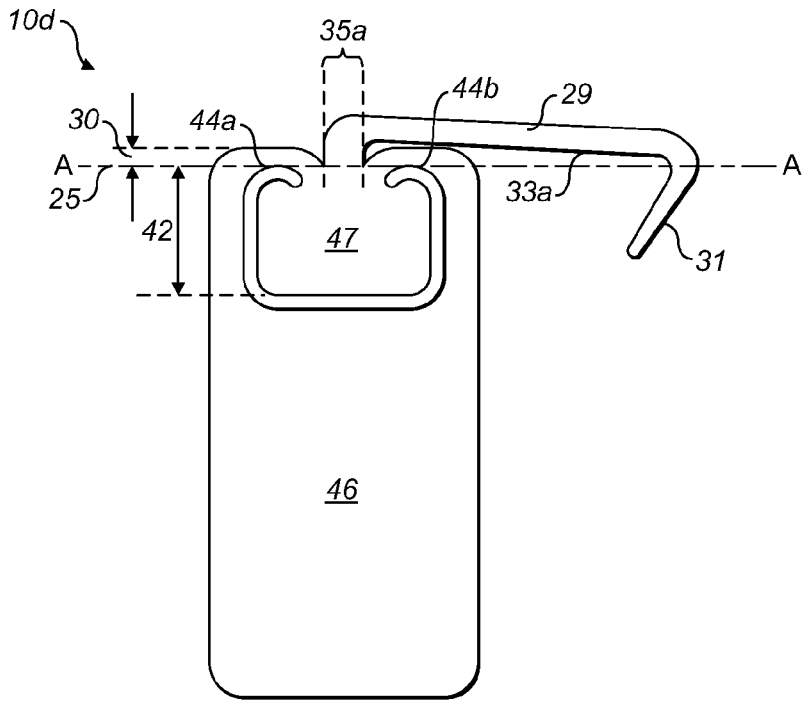
FIG. 9 shows a plan view of a fourth embodiment of the invention.

In arrangements in which the line of abutment 25 is defined by abutting edges, there are at least two abutting edges, which provide accurate locating ability—with two such edges it is possible to accurately locate the bookmark in a predefined preferred position without needing to perform further positioning steps. More preferably, the at least two abutting edges include two laterally separated and substantially parallel edges located towards the top of an anchor portion of the bookmark—in which case it will not be necessary to push the bookmark into the spine of the book in order to perform correct positioning (although this can assist in correct positioning and keeping the correct position). Such an arrangement is shown in FIG. 9, to be described below.

Referring back to FIG. 3, the end separation distance 37 is between 3 cm and 9 cm, preferably between 4 cm and 8 cm, and most preferably between 5 cm and 7 cm. It will be appreciated that the end separation distance 37 will be selected within these ranges based on factors such as the width of the book and the number of pages therein: longer end separation distances are particularly suitable for books with more than average number of pages. The page retaining element 31 extends from the line of abutment 25 by an extension distance 39 of between 1 cm and 3 cm, this being an effective page retaining element length. It will be appreciated that the extension distance 39 will be selected from within this range based on factors such as material from which the bookmark 10*a* is to be manufactured and typeset of the book within which the bookmark is to be utilized. Further, as regards overall dimensions of the bookmark, the width 48 of the bookmark 10*a*, measured parallel to the line of abutment, is within a range of between 7 cm and 16 cm, preferably between 9 cm and 13 cm, and most preferably between 10 cm and 12 cm.

Figure 4B:
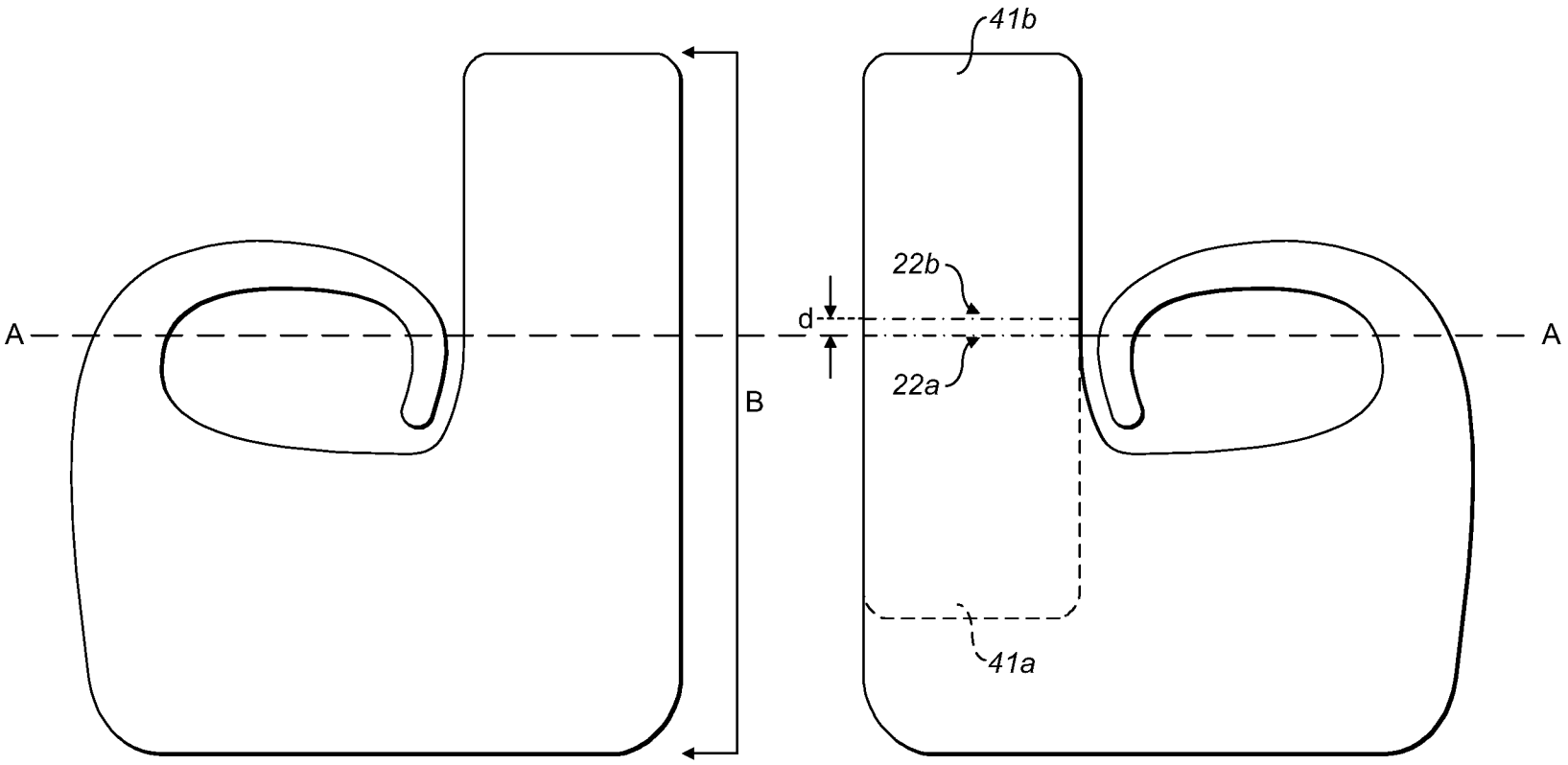
FIG. 4*b* shows topside and underside plan views of a laminar sheet blank cut-out for a bookmark according to the first embodiment of the invention having a double-creased hinge, in unfolded form.
Figure 4C:
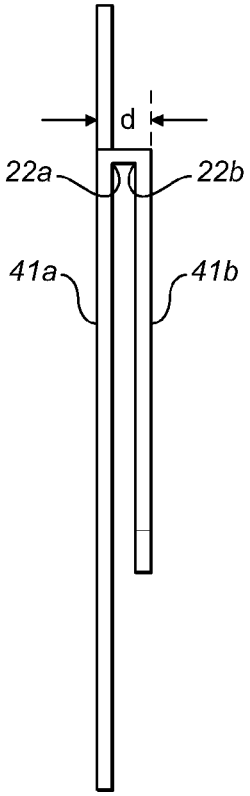
FIG. 4*c* shows a side view of the bookmark shown in FIG. 4*b;*
Figure 4D:
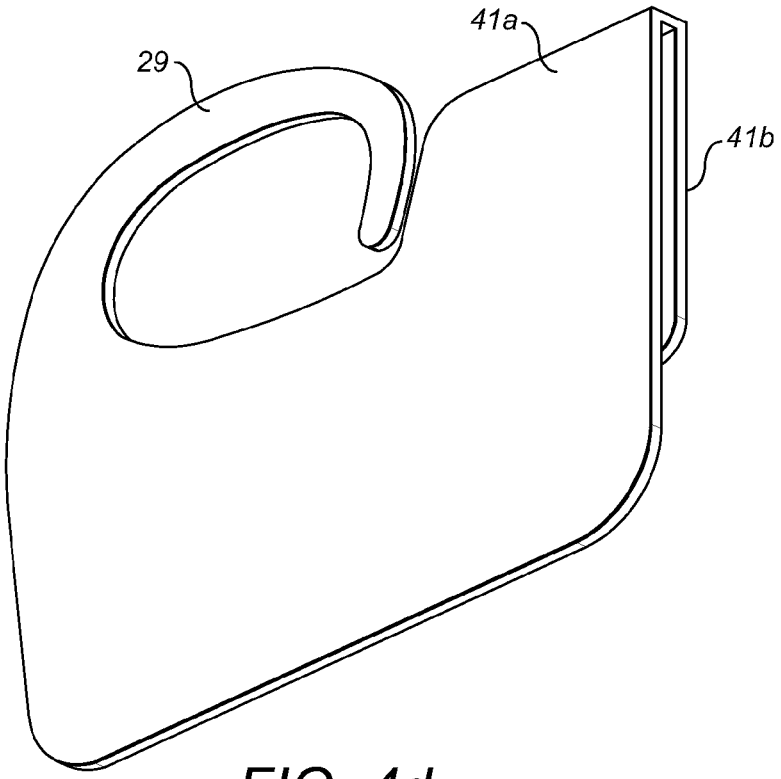
FIG. 4*d* shows a perspective view of the bookmark shown in FIG. 4*b;*

FIG. 4 shows a plan view of a laminar sheet blank cut-out forming the bookmark 10*a* in unfolded form, which shows an arrangement of the pair of clip parts 21 according to the first embodiment. The clip parts 21 are mutually attached via the abutment means 23, which, as described above in this embodiment, comprises a hinge part. As will be appreciated from a review of FIG. 3 in conjunction with FIG. 4, in one arrangement the hinge part 23 comprises a folded part (shown as the finely dotted line in FIG. 4), which, in use, enables the bookmark to assume the configuration shown in FIG. 3. Referring to FIGS. 4*b* and 4*c*, in an alternative arrangement, the folded part is located between two parallel folds (or creases) 22*a*, 22*b* formed in the underside of the hinge part 23 such that in the fully folded position shown in FIG. 3, the first clip part 41*a* lies parallel to, and spaced apart from, the second clip part 41*b*. The first and second clip parts are spaced apart by a distance d which is directly dependent on the distance between the two folds 22*a*, 22*b;* this distance is preferably between 1 mm and 5 mm, more preferably between 2 mm and 4 mm and most preferably 3 mm. Each of the parallel folds 22*a*, 22*b*, may be formed in the sheet blank by applying an appropriate punching, or stamping, force along the indicated crease lines; preferably the creases are applied at the same time as the bookmark is cut from the laminar material. Accordingly a suitably configured jig, namely one that can accommodate punching and cutting in a single action, is most preferably utilized to manufacture the bookmark shown in FIG. 3. As a further alternative (not shown), the folded portion lying between the two folds 22*a*, 22*b* could be cut along part of its length, preferably in the middle of the fold line, so as to reduce the resistance to the folding of the respective clip parts 41*a*, 41*b* about the folds 22*a*, 22*b*. The degree of cutting can vary dependent on the material from which the bookmark is fabricated, but 1-2 cmm of cutting has been found to facilitate the required folding. The cutting may be in the form of a single cut or a series of cuts along the length of the fold line.

In subsequent figures the abutment means 23 is shown as a single line; however, it is to be understood that in any of the embodiments having a hinge part as the abutment means, this part can be embodied as a single crease or as a double crease, per FIGS. 4*b* and 4*c*.

Each of one of the pair of clip parts 21 can be considered to be one of the front 41*a* or rear 41*b* flaps, which are both arranged to one side of the flexible arm 29 when the bookmark 10*a* is in the folded position. In the arrangements shown in FIGS. 3-4*c* the abutment area 24, and thus pair of elements 41*a*, 41*b*, is arranged relatively close to the second end of the flexible arm 35*b* and relatively far from the first end of the flexible arm 35*a*, but other embodiments, the elements 41*a*, 41*b* are differently located with respect to the abutment area 24. For example, and turning to FIGS. 5 and 6, in another embodiment, the abutment area is arranged relatively close to the first end of the flexible arm 35*a* and relatively far from the second end of the flexible arm 35*b*.

Figure 5:
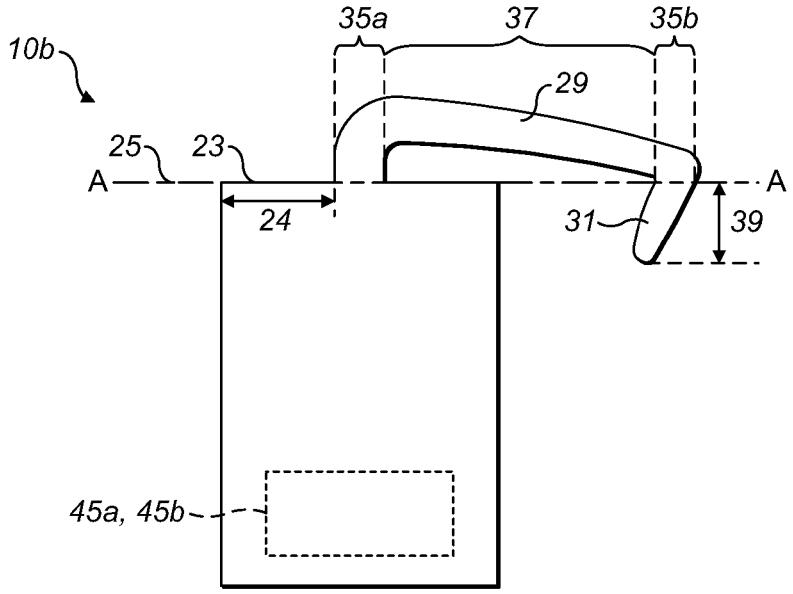
FIG. 5 shows a plan view of a bookmark according to a second embodiment of the invention, in folded form.
Figure 6:
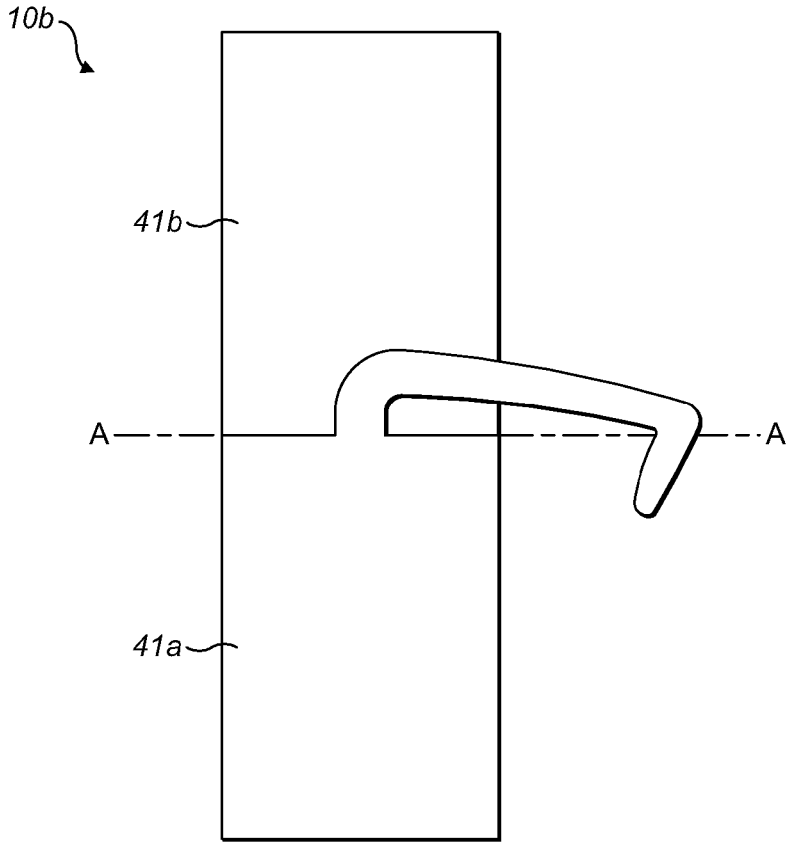
FIG. 6 shows a plan view of a laminar sheet blank cut-out for a bookmark according to the second embodiment of the invention, in unfolded form.

As regards the width of the flexible arm 29 in relation to the second embodiment shown in FIGS. 5 and 6, the width of the flexible arm (measured perpendicular to the line of abutment 25), where it meets the first end 35*a*, is approximately 1.0 cm; the width of the flexible arm at the middle of the flexible arm is approximately 0.8 cm, while the minimum width of the flexible arm (at the second end 35*b* of the flexible arm) is approximately 0.7 cm. Thus the average width of the flexible arm, averaged along the line of abutment 25, is therefore more than 0.7 cm, and is in fact, in this embodiment, greater than 0.8 cm (and less than 0.9 cm)—in particular, approximately 0.85 cm. In this embodiment the maximum separation between the line of abutment 25 and the inner edge 33*a* of the flexible arm is approximately 0.8 cm.

It will be appreciated from FIGS. 3-6 that in these embodiments the abutment area 24 is embodied as a single area; in a preferred arrangement the width of the abutment area 24, when measured along the line of abutment 25, is between 2 cm and 7 cm, preferably 3 cm and 6 cm, and most preferably between 4 cm and 5 cm. As for the end separation distance 37 and the extension distance 39, the actual choice of width is dependent on the type of book in which the bookmark 10*a*, 10*b* is intended to be used.

Figure 7:
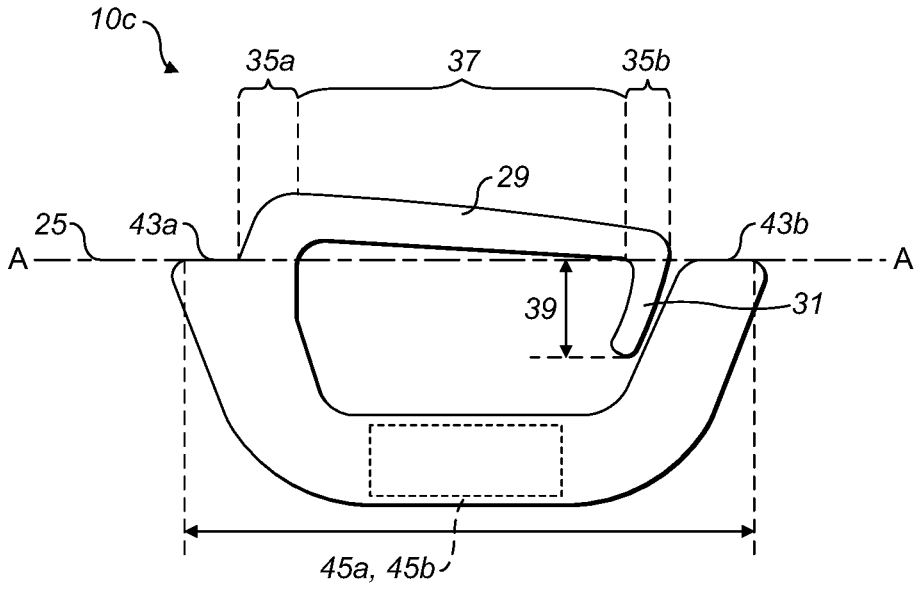
FIG. 7 shows a plan view of a bookmark according to a third embodiment of the invention, in folded form.

Turning to FIG. 7, as an alternative to embodying the abutment area 24 as a single area, it could be embodied as two abutment areas 43*a*, 43*b*, each arranged along the line of abutment 25 to different respective sides 35*a*, 35*b* of the flexible arm 29. This embodiment advantageously enables the bookmark 10*c* to be supported at two points along the top of the book 7, each either side of the flexible arm 29; this is particularly suitable for trim bookmarks comprising little other than the releasable page holder and abutment means, since it increases the stability of the bookmark 10*c* with respect to the book. Further, this embodiment can be particularly beneficial when the bookmark 10*c* is used in books comprising greater than 400 pages, where the above-mentioned tilt of the page retaining element 31 (caused as the page retaining element is moved far from the abutment means 23) results in a twisting force being exerted on the abutment means 23. In this embodiment the maximum separation between the line of abutment 25 and the inner edge 33*a* of the flexible arm is approximately 0.3 cm.

Figure 8:
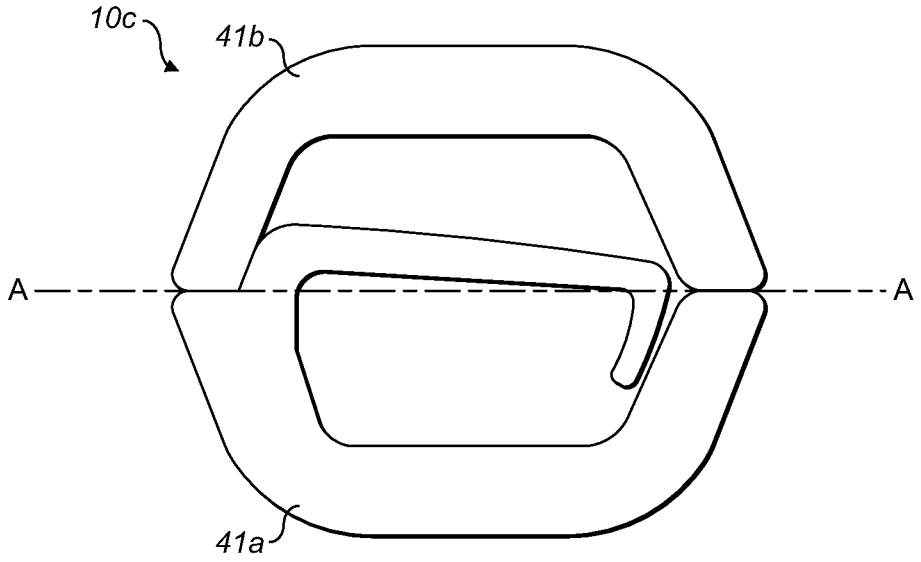
FIG. 8 shows a plan view of a laminar sheet blank cut-out for a bookmark according to the third embodiment of the invention, in unfolded form.

As regards the width of the flexible arm 29 in relation to the third embodiment shown in FIGS. 7 and 8, the width of the flexible arm (measured perpendicular to the line of abutment 25), where it meets the first end 35*a*, is approximately 1.0 cm; the width of the flexible arm at the middle of the flexible arm is approximately 0.7 cm, while the minimum width of the flexible arm (at the second end 35*b* of the flexible arm) is approximately 0.5 cm. Thus the average width of the flexible arm, averaged along the line of abutment, is therefore more than 0.5 cm, and is in fact, in this embodiment, greater than 0.6 cm (and less than 0.7 cm)—in particular, approximately 0.65 cm.

As mentioned briefly above, in particularly preferred embodiments, and indeed shown in each of FIGS. 3, 5 and 7, the pair of clip parts 21 is embodied as a pair of magnetic elements 45*a*, 45*b* adapted to clip over a book part. The magnetic elements 45*a*, 45*b* can be attached to the inner faces of the flaps 41*a*, 41*b* by adhesive or similar fixing means, and positioned such that, in unfolded form, a first of the pair of elements is in registration with a second of the pair of elements. This ensures that, when the bookmark 10*a*, 10*b*, 10*c* is in folded form and attached to a book part in the manner described above, the bookmark is securely, but releasably, attached to the book part. This mode, and relative strength, of attachment is particularly beneficial in view of the aforementioned twisting force exerted on the abutment means 23 during use of the bookmark.

In the foregoing embodiments the bookmark 10*a*, 10*b*, 10*c* is preferably formed from a single-sheet cut and folded blank to which the magnetic elements have been applied. More specifically, in one arrangement the clip parts 21 and flexible arm 29 can be unitarily formed from a single cut-and-folded sheet material blank. That the bookmark can be formed from a single-sheet in each embodiment is evident from the plan views shown in FIGS. 4, 4*b*, 6 and 8: it can be seen that the various parts of the bookmark can be stamped out of a single sheet. Manufacture of the bookmark 10*a*, 10*b*, 10*c* can be viewed as a three-step process, the first being the cutting of the sheet and the defining of the hinge part, the second being the folding of the sheet along the line of abutment and the third being the addition of the magnetic elements 45*a*, 45*b*.

Referring to FIG. 9, in an alternative embodiment the clip parts 21 comprise a tab 47, integrally formed in a laminar element 46. In this embodiment the abutment means 23 comprises abutting edges 44*a*, 44*b*, and at least some of the part of the flexible arm 29 is in the vertically extending zone between the two position defining abutments 44*a*, 44*b*. The tab 47 is preferably connected substantially centrally between the two position defining abutments 44*a*, 44*b*. Connecting the arm 29 in this way has the advantage that a downward force exerted when positioning the bookmark 10*d* can be relatively well-balanced between the two abutments, thereby ensuring a more convenient and reliable positioning. This is particularly effective when the first end of the flexible arm 35*a* arm is located substantially centrally between the two position defining abutments 44. In this embodiment, as for those described above, the clip part, or tab, 47 preferably has a length 42 measured perpendicular to the line of abutment 25 and parallel to said clipping plane, which is greater than at least twice the maximum separation 30 between the inner edge of the flexible arm and the line of abutment. Further the maximum separation between the line of abutment 25 and the inner edge 33*a* of the flexible arm is approximately 0.3 cm, while the width of the flexible arm 29 is substantially constant along its length, approximately 0.6 cm; in an alternative embodiment, the flexible arm 29 could have a width which is substantially constant along its length, approximately 0.5 cm.

Operation of a bookmark according to the afore-described embodiments of the invention will now be described. In use, the page retaining edge 32*a* contacts the page currently being read or marked, thus retaining the page in the back of the book. When the current page is turned the page retaining element 31 and the arm 29 are lifted up by the action of turning the page, and the arm 29 twists, so that the page retaining edge 32*a* is disengaged with the page, allowing the page to turn. The page retaining element 31 then springs back to the proceeding page, where the page retaining edge 32*a* engages with the page.

Thus the page retaining element 31 can remain in the book whilst the book is being read, and, since it automatically engages with successive pages during reading of the book, the page retaining element 31 does not need removing from the book either during reading or when the user has finished reading and wishes to close the book. When the bookmark is formed from a flexible material, the page retaining element 31 is effectively biased towards the plane of the abutment means 23 when it is pushed out of the plane. The automatic page following functionality results, at least in part, from the magnitude of the biasing force between the abutment means 23 and the page retaining element 31. The appropriate flexibility is provided at least in part by the arm 29 being wider, on average, than the page retaining element 31.

On the other hand, the arm 29 has flexibility which is sufficient to ensure that the page retaining element 31 does not damage a page in an average paperback book when the page is turned, and the retained edge of the page is moved from the back of the book towards the front of the book, when the bookmark is correctly positioned.

A further embodiment of the present invention will now be described with reference to FIG. 10. In this embodiment the edge-of-page line A-A and the page retaining edge 32*a* of the page retaining element 31 are formed at 90° to each other and the page retaining edge 32*a* is straight. The page retaining element 31 can be relatively thin, so that the page retaining element can be formed from reasonably strong substrate material without the page retaining element protruding above the current page significantly—thus avoiding splaying of the pages of the book when the page retaining element is left in the current page when the book is closed. The average width of the page retaining element 31 over the portion of the page retaining element which overlies the page when the bookmark is in the preferred configuration is preferably less than 5 mm, and preferably the page retaining element has a substantially uniform width (for example the difference in the width is less than approximately 3 mm). The page retaining element preferably has an average width of more than 2 mm. This thickness provides the necessary resilience, whilst having an average width of less than 5 mm provides the advantage that the page retaining element 31 does not protrude above the marked page significantly. Note that a similar average width of page retaining element, of between 2 mm and 5 mm, is preferably also used in relation to all embodiments described herein.

Figure 10:
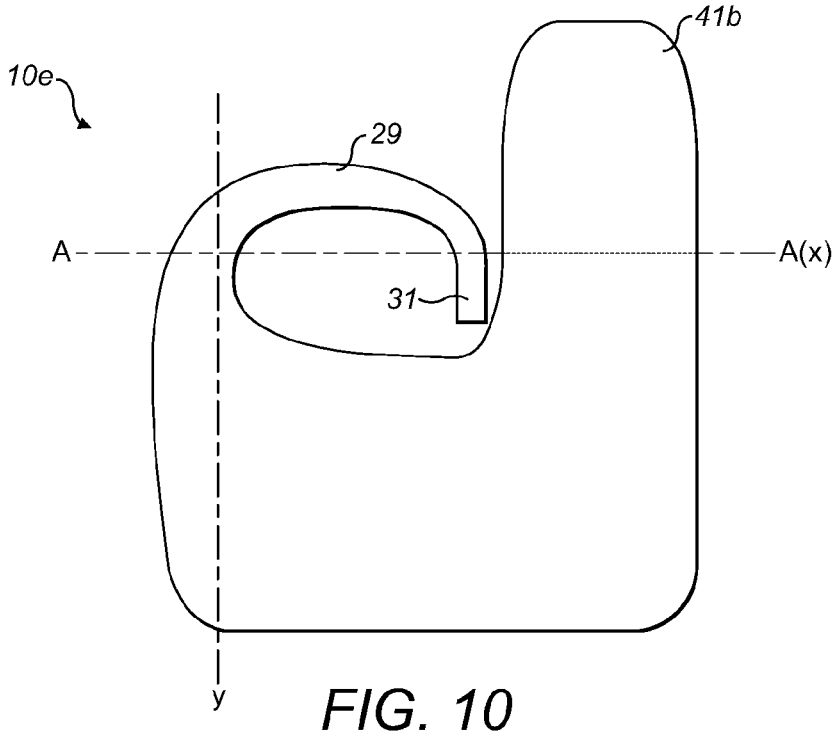
FIG. 10 shows a plan view of a fifth embodiment of the invention, in folded form.
Figure 11A:
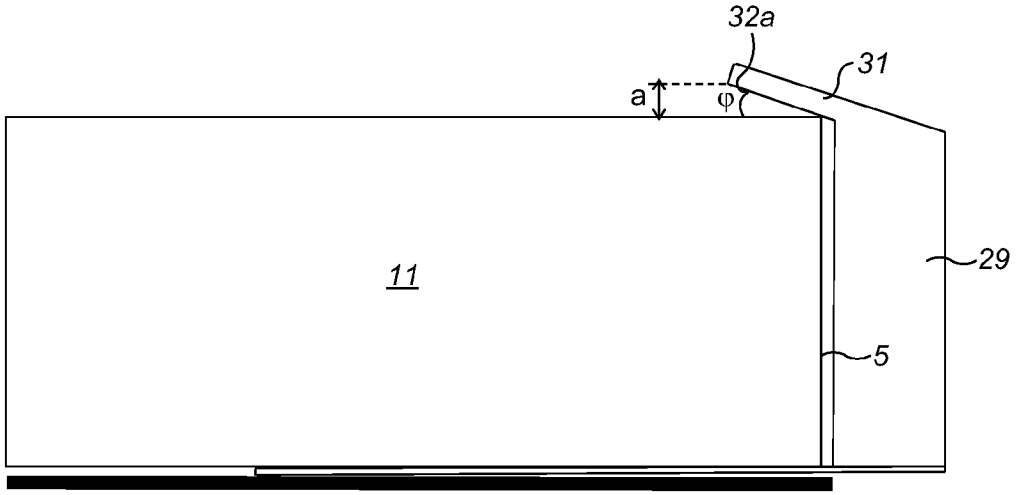
FIG. 11*a* shows a schematic side view of the bookmark of FIG. 10 inserted into a book.
Figure 11B:
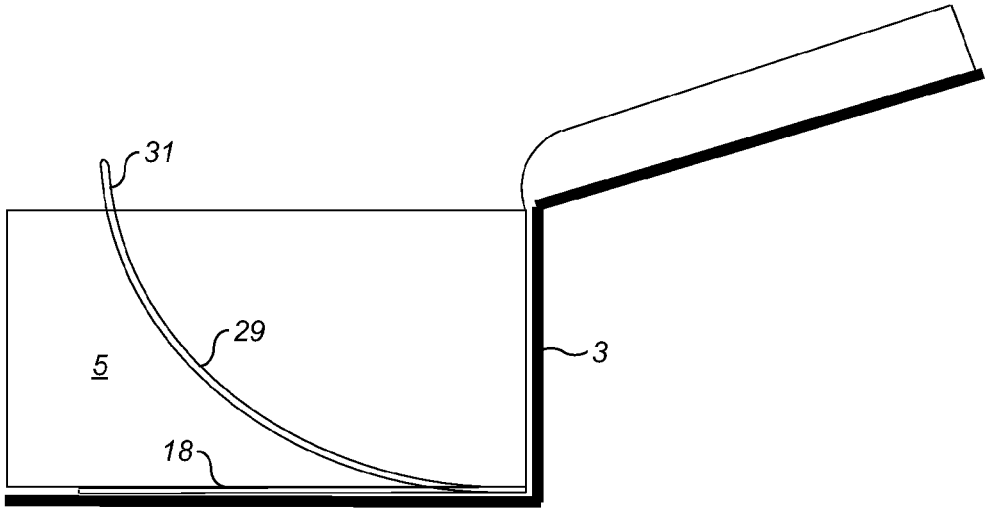
FIG. 11*b* shows a schematic top view of the bookmark of FIG. 10 inserted into a book.
Figure 11C:
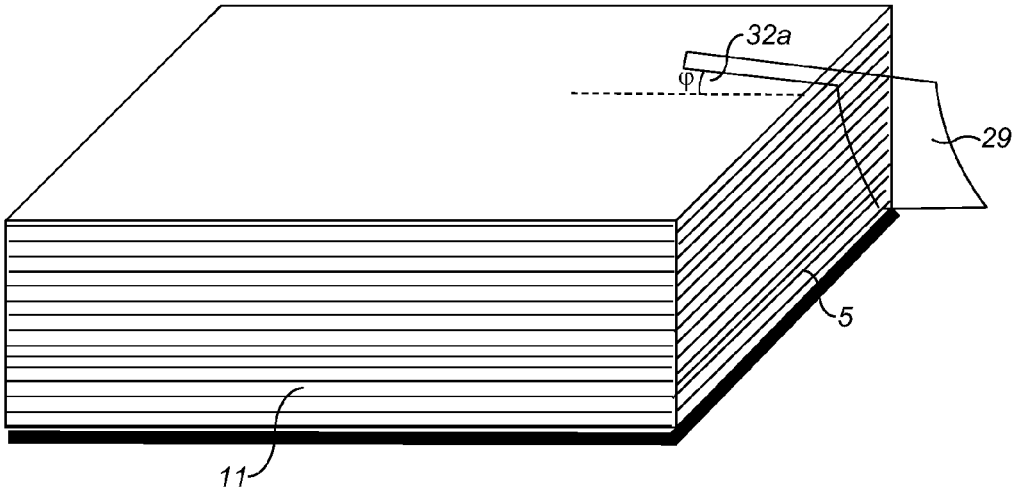
FIG. 11*c* shows a schematic perspective view of the bookmark of FIG. 10 inserted into a book.

FIGS. 11*a*, 11*b* and 11*c* show the bookmark 10*e* of FIG. 10 inserted into a book (as a view from the side of the book 11 opposite the spine 3, a view from the top of the pages 5 of the book, and a perspective view respectively). When the bookmark of FIG. 10 is inserted into a book, and is used to hold a thick set of pages, so that the abutment means 23 is disposed some distance from the page retaining element 31, the arm 29 tends to twist when the abutment means 23 is anchored in relation to the book and the page retaining element 31 is positioned to mark a current page in the book. This is because the arm 29 is under tension. The rotation caused by this twisting has the effect that the end of the page retaining element 31 also rotates and lifts up from the retained page by a distance a, and the page retaining edge 32*a* makes an angle $\phi$ with the surface of the engaged page as can be seen in the Figures. The rotation of the arm 29 is due to a reaction force from the book, which acts on the arm 29 at the point where the arm 29 contacts the page retaining element 31. The force effectively applies a twisting motion to the arm 29, rotating it in a complex manner. FIG. 10 shows two axes x and y, and in order to simplify the discussion of the twisting motion of the arm 29 the rotation of the arm can be considered to have two components: a rotation about the x axis and a rotation about the y axis. The components of rotation about both of these axes will be considered separately.

When the bookmark is located in the preferred configuration in the book the x axis is parallel to the top surface of the page 5. The rotation about the x axis tends to rotate the top edge of the arm 29 towards the back cover of the book, causing the page retaining element 31 to point towards upwards. When the bookmark 10*e* is located in the preferred configuration in the book the y axis is parallel to the spine 3 of the book. The rotation about the y axis tends to rotate the free end of the arm 29 away from the back cover of the book. The component of the force tending to twist the arm 29 towards the top of the pages, i.e. causing the rotation about the x axis, causes the page retaining edge 32*a* of the page retaining element 31 to lift up from the surface of the page it is marking by an angle ϕ, as shown in FIG. 11*a*. This causes the free end of the page retaining element 31 to lift up from the page by a distance a, also shown in FIG. 11*a*. Not only does this effect cause an undesirable distraction to the reader, but it can reduce the effectiveness of the page retaining element 31. Hence, it is advantageous to reduce this distance as much as possible.

By having the turning of a page causing the arm to twist in order to tilt the page retaining element thereby to release the current page, a function is achieved which has many competing requirements—e.g. on the one hand the page retaining element should retain the page during reading, but release the page when a page is turned. Further, the page retaining element should ideally not tear or otherwise harm the page during reading—when a single page is being used to lift the page retaining element from the back of the book—if the tension is too great, the page will easily tear.

The embodiments of FIGS. 3-8 do not lift up in the manner shown in FIG. 11*a* because, and as described above, the page retaining edge 32*a* forms an angle of less than 90° with respect to the edge-of-page line A-A, when measured away from the page retaining element 31, and more preferably, an angle of between 55° and 80°, yet more preferably between 65° and 78°. When this angle is rotated, it comes into play as a compensating effect which compensates for the angle ϕ shown in FIG. 11*a* and FIG. 11*c* between the page retaining edge 32*a* and the surface of the book which occurs when the bookmark of FIG. 10 is inserted into a book.

Figure 12:
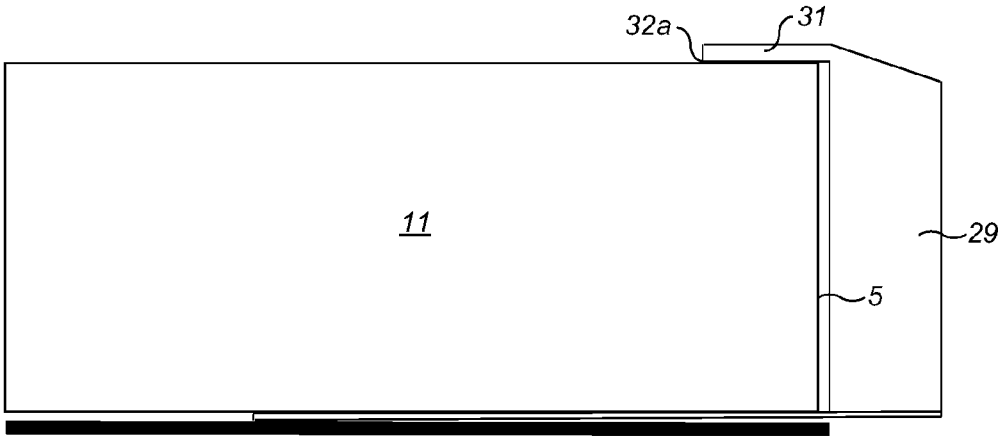
FIG. 12 shows a schematic plan view of the bookmark of FIG. 3 viewed from the side of the book opposite the spine.

FIG. 12 shows, for example, the bookmark 10*a* of FIG. 3 inserted into a book (as a view from the side of the book opposite the spine, a view from the top of the book, and a perspective view respectively). It can be seen that the bookmark is holding a thick set of pages (over 2 cm), yet the page engaging edge 32*a* lies substantially flat to the surface of the page; by this we mean that the free end is at most 2 mm, preferably less than 1 mm from the surface of the page. As discussed above, the rotation about the x axis tends to cause the unwanted effect of pointing the page retaining element 31 towards the front cover of the book. However, the angle between the page retaining element 31 and the arm 29 per FIGS. 3-8 compensates for this rotation, to ensure that the page retaining edge 32*a* of the page retaining element 31 lies substantially along the surface of the page, as shown in FIG. 12, rather than protruding at an angle as shown in FIG. 11*a*.

Figure 13A:
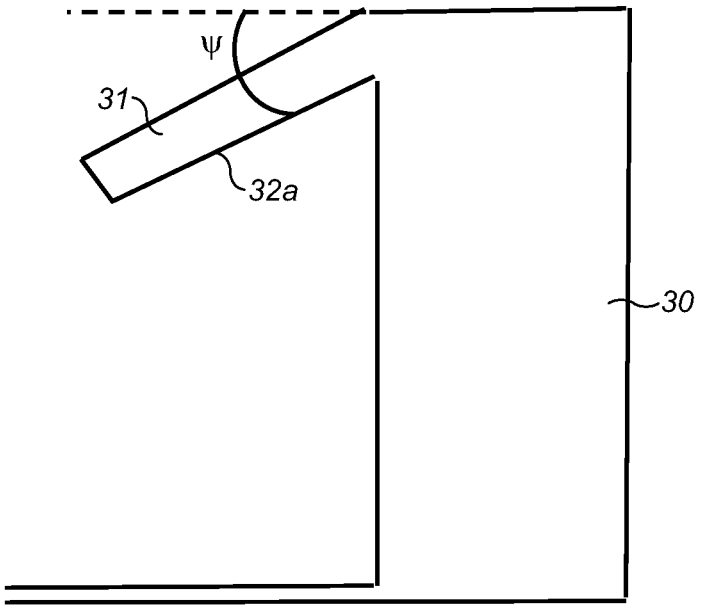
FIG. 13*a* shows a schematic side view of the bookmark of FIG. 3 inserted into a book.

In order to consider the rotation of the page retaining element 31 of the bookmark in more detail a discussion of the operation of the page retaining element 31 shown in FIGS. 3 and 4 in use will now be made with reference to FIGS. 13*a* and 13*b* which are views of the arm taken along the x axis, and are used to illustrate the effect of rotation about the y axis alone (without any x axis rotation). When the abutment means 23 is inserted over the cover of a book, and the page retaining element 31 is placed a relatively long way therefrom, for example on the first page of the book, the arm 29 and therefore the page retaining element 31 undergoes a large amount of rotation about the y axis. The effect of a relatively large amount of rotation about the y axis is shown in FIG. 13*a*. In this case, the angle ψ between the page retaining element and the horizontal (i.e. a surface along which the x and y axes lie) is at a relatively high value. This angle is however used to compensate for the rotation about the x axis, which, although not shown here, is also at a relatively high value, since the return force on the arm is relatively high and the amount of twisting about the x axis will be correspondingly high, and the two effects are preferably arranged to substantially compensate each other so that the end of the page retaining element rests near to the page, even when the amount of pages being held in the bookmark is high as shown in FIG. 13*a*.

Figure 13B:
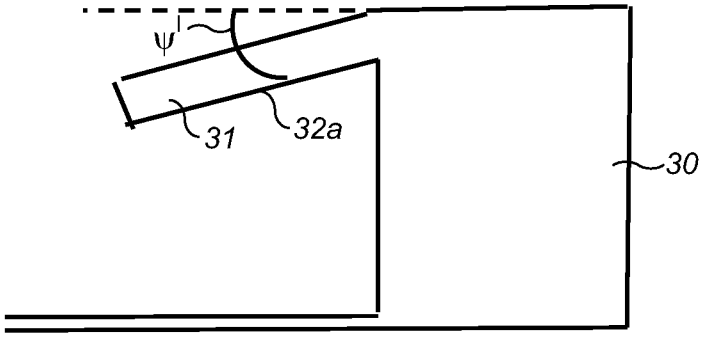
FIG. 13*b* shows a schematic top view of the bookmark of FIG. 3 inserted into a book.

As the book is read and the pages are turned successively, the half of the book being held by the page retaining element 31 has successively fewer pages as shown in FIG. 13*b*. This has the effect of reducing the amount of rotation to which the arm 29 is subject (about both the x axis and the y axis). The effect of reducing the rotation about the y axis has the effect of reducing an effective angle ψ' between the page retaining element 31 and the horizontal. The angle ψ' gradually varies between the value ψ and 0° as the amount of rotation about the y axis varies. Thus, the angle which compensates the rotation about the x axis reduces as the rotation about the y axis reduces. Therefore the angle which compensates the rotation about the x axis also reduces as the rotation about the x axis reduces. Preferably the effective angle ψ' formed between the page retaining element 31 and the horizontal at different amounts of rotation together with the resilience of the material and the dimensions of the bookmark are such that the effective angle ψ' and the amount of rotation about the x axis are approximately equal irrespective of the amount of pages held in the bookmark, so that page retaining edge 32*a* will lie along the surface of the held page for all thicknesses of books, and for all relative displacements between the abutment means 23 and the page retaining element 31 in the book.

When the end of the book is reached the arm 29 will be virtually flat, and the bookmark will have substantially the planar shape shown in FIG. 3. In this case, the effective angle between the page retaining element 31 and the horizontal is approximately zero, so that the page retaining edge 32*a* still lies along the surface of the held page.

Figure 14:
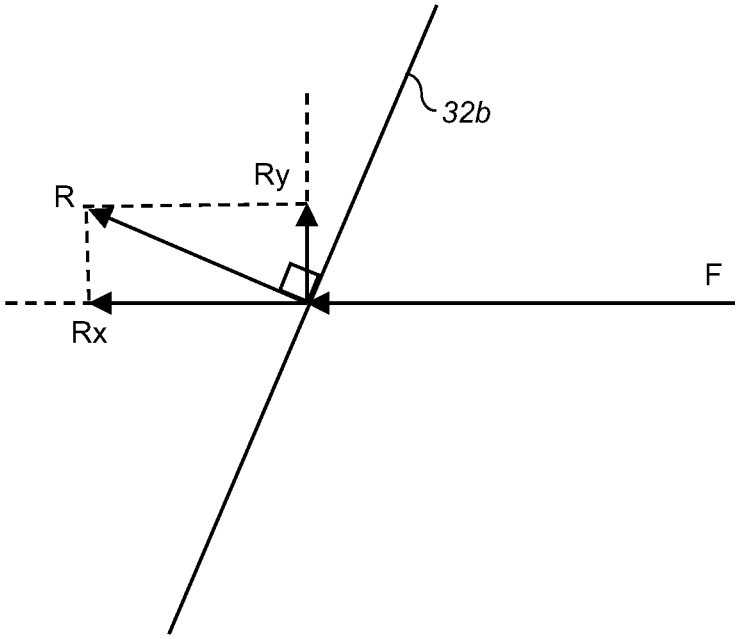
FIG. 14 is a diagram showing the force acting on the bookmark of FIG. 3.

In addition to a page-engaging, or page retaining, edge 32*a*, the page retaining element 31 comprises a force-receiving edge 32*b* disposed opposite the page retaining edge 32*a*. The page retaining element 31 FIG. 14 shows the twisting force F as it is received by the force-receiving edge 32*b* of the bookmark of FIG. 3. A reaction force R normal to the surface of the force-receiving edge is produced, even if the applied force is in the x direction only. The force R can be resolved into two components in the x and y axis, shown as $R_x$ and $R_y$ respectively. This means that a non-zero component $R_y$ of the force imparted from the page to the force-receiving edge is in the y direction, towards the top of the book. This causes a rotation in the arm about the x axis which tends to rotate the page retaining element away from the page which it is marking Furthermore, the component of the reaction force in the x direction causes the arm 29 to rotate about the y axis, which has the effect of lifting the entire page retaining element vertically from the page. Thus, releasing the retained page is easier than in the known bookmarks. As described above, the page retaining element 31 is an elongate element, and in at least some embodiments the width of the element reduces over the extension distance 39. This has the advantage of reducing the amount of splaying of the pages either side of the page retaining element 31 when a book in which it is inserted is shut.

Figure 15:
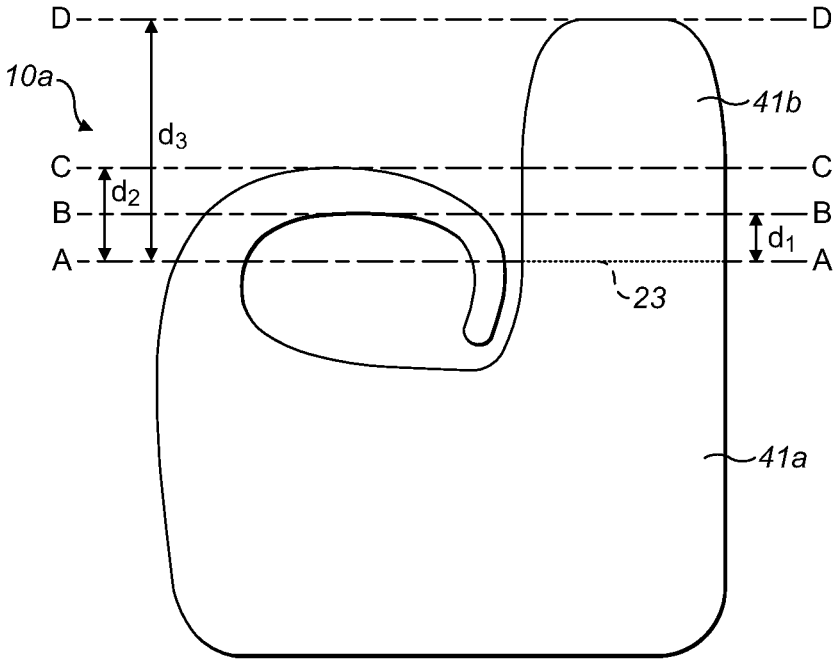
FIG. 15 is a schematic diagram showing preferred dimensions of various parts characterizing the bookmark of FIG. 3.

FIG. 15 shows further examples of the preferred dimensions of the bookmark 10*a*-10*e*. These dimensions are the distance between the line of abutment 25 (A-A) and the inner edge 33*a*, shown as B-B; the distance between the line of abutment 25 (A-A) and the outer edge 35*a*, shown as C-C; and the distance between the line of abutment 25 (A-A) and the bottom of the rear flap 41*a* (shown as D-D).

The distance $d_1$ is the minimum vertical distance between the line of abutment 25 (line A-A) and the maximum height of the inner edge 33*a* of the arm. Preferably the distance $d_1$ is at least 3 mm—and less than 2 cm—most preferably between 5 mm and 1.5 cm. This provides additional leverage to enhance the releasing operation of the page retaining element when the page retaining element to be moved by the retained edge of the current page away from the back of the book towards the front of the book. Such movement of the page retaining element 31 causes the arm 29 to twist in order to tilt the page retaining element 31 and thereby to release the current page and then, in response to reposition the page retaining element 31 on the next page; increased height of the highest point of the lower edge of the arm increases the twisting force on the arm.

The distance $d_2$ is the minimum vertical distance between the line of abutment 25 (line A-A) and the maximum height of the outer edge 33*b* of the arm. Preferably the distance $d_2$ is less than 5 cm—most preferably less than 2.5 cm. Increasing the distance $d_3$ between the top of the arm 29 and the top of the page has the effect of increasing the moment which can be imparted to the arm 29 by the action of turning the page. How much the arm is twisted by a given moment depends on the stiffness of the arm. This is affected by the width of the arm. Hence, by altering the width of the arm the effect that the moment has on the arm can be altered, and increasing the distance $d_1$ will have the effect of weakening the arm, so that it may be twisted more easily by turning a page. However, if the arm 29 becomes too thin the page retaining element will not retain the page correctly, since the arm will not bias the page retaining element into the plane of the abutment means 23 sufficiently. The distance $d_3$, being the distance between the line of abutment 25 and the bottom of the rear flap 41*b* (line D-D), is preferably less than 9 cm and most preferably less than 6 cm, but in any event greater than 2 cm. The distance is selected so as to limit the extent to which the flap 41*b* covers the book part when the bookmark 10*a*-10*e* clips over the back of the book.

Figure 16:
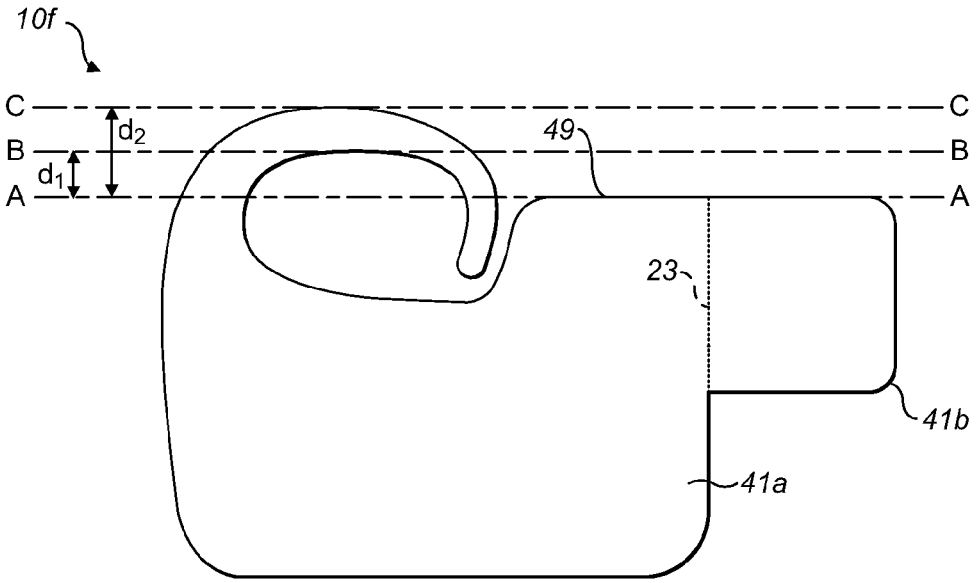
FIG. 16 shows in plan view a sixth embodiment of the invention, in unfolded form.
Figure 17:
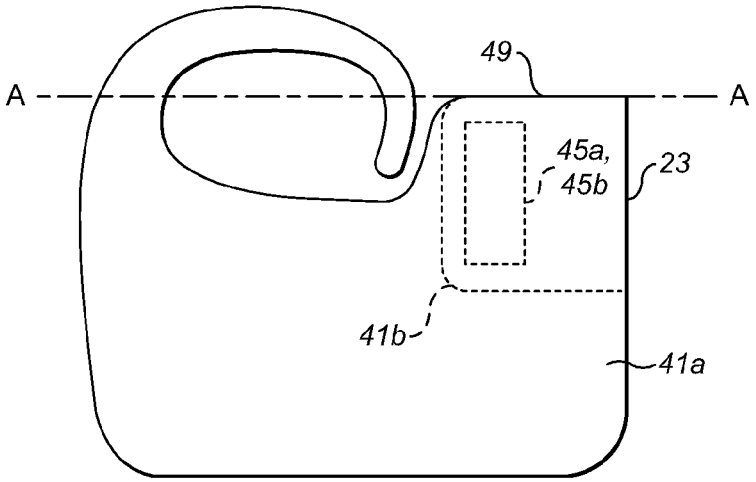
FIG. 17 shows in plan view the sixth embodiment of the invention, in folded form.

FIGS. 16 and 17 illustrate a further embodiment of the invention. In this embodiment of the invention, which in most respects may be substantially as described above in relation to the first embodiment, and with dimensions arranged for example in relation to FIG. 15 (and the description above in relation to the first embodiment and FIG. 15 and the should be taken to apply, except that in this embodiment the abutment means 23 is arranged substantially perpendicular to the arrangement in the embodiment shown in FIG. 15, and the clip part 41*b* is arranged to hinge around a line parallel to, or collocated with to the abutment line 23. In this embodiment, the part of the paperback book cover with which the abutment means 23 aligns is the free side edge of the paperback book cover. In this embodiment, the magnetic clip formed by the clip parts 41*a*, 441*b* and/or magnets 45*a*, 45*b* is arranged to be placed over the book cover by putting it into place over the free side edge of the paperback book cover against which the abutment means is then abutted to align the bookmark against the free side edge of the book cover. Yet further, the bookmark may be used, alternatively, by placing the magnetic clip over a page of a hardback or paperback book by putting it into place over the free side edge of a page, or set of pages, in the book, in which case the part of the book with which the abutment means aligns is the free side edge of a page, or set of pages, of the book.

In this embodiment the bookmark also includes, in addition to the abutment means, an alignment edge 49 (which may in alternative embodiments be a marking or other delineation) which provides a guide allowing the user to correctly position the bookmark with respect to the top edge of the book cover or a page, or set of pages of the book), or allowing the user to correctly position the bookmark with respect to the bottom edge of the book cover or a page, or set of pages of the book. Correct positioning is achieved when the alignment edge 49 and the top, or bottom, edge of the book cover are substantially parallel. The alignment edge 49 and the abutment means 23 are in this embodiment arranged substantially perpendicular to one another so at to be positioned against, or in relation to, the respective free side edge and a respective top edge or bottom edge of a book part.

In the embodiment of the invention shown in FIGS. 16 and 17 the first end of the flexible arm is arranged to be located adjacent the top edge (or the bottom edge) of the paperback book cover when the abutment part is abutted against the free side edge of the paperback book cover, and when the alignment edge 49 and the top, or bottom, edge of the book cover are substantially parallel (i.e. when a bookmark is correctly positioned in a book). In this positioning, the flexible arm extends along the top edge or the bottom edge of the paperback book (and along the top edges or the bottom edges of pages of the book) and the page retaining element extends over at least the respective top edge or bottom edge of a page, to engage and retain a page when the bookmark is in use.

Note that the above embodiments are exemplary only. In a preferred embodiment, the material is polypropylene. However, bookmarks according to different embodiments of the invention can be fabricated out of any flexible material. Examples include plastic, metal, and card.

In preferred embodiments, the bookmark is cut from sheet material. For example, the bookmark may be die cut or laser cut. An advantage of cutting from sheet material is that it is inexpensive; hence any design which allows for cutting as a unitary element from sheet material will have significant cost advantages. Furthermore, the sheet material is preferably printed with graphics before being cut.

Where the marker is formed from cut sheet material, the thickness of the material is preferably less than 2 mm, and more preferably less than 1.2 mm. Where the material is plastic, the sheet material preferably has a thickness of more than 0.3 mm, since any less thickness is likely to be insufficiently rigid to provide for an adequate automated bookmark function. A thickness of between 0.4 mm and 1 mm is preferred, most preferably a thickness of between 0.5 mm and 0.7 mm.

In some preferred embodiments, the material of at least the page retaining element is at least partially transparent so as to reduce obscuration of any part of the retained page during reading thereof. In an envisaged embodiment, the page retaining element may be more transparent than other parts of the bookmark, thereby providing the above advantage whilst allowing the remainder to carry relatively opaque graphics and coloring.

The Figures show bookmarks for use in left-to-right reading books. The bookmarks according to embodiments of the present invention would work for books which are intended to be read right-to-left, if they were a mirror image of those shown in the foregoing figures, and inserted in the back of the book with the page retaining element extending to the left of the spine when the book was being read.

Since the arm is formed of a material such as plastic, which may lack the longevity of other materials such as metal, it is important for robustness, particularly given that with some books there will be a large amount of pages to be gripped and in that case a large degree of flexing in the arm, not to concentrate stress in one part of the arm. Hence the width of the laterally-extending part, i.e. that part between the upwardlyextending part above the attachment point and the downwardly-extending part forming the page retaining element, should preferably not vary significantly—preferably this variation is less than a ratio of 4:1 at any point along the flexible arm, more preferably the variation is less than 2:1.

Furthermore, the average width of the arm is preferably greater than the average width of the page retaining element. Again, with a material such as plastic, particularly relatively thin plastic, this assists with longevity as it increases the robustness of the arm where it is needed, particularly when the arm is flexed considerably.

In alternative embodiments, the marker may include one or more non-laminar features, for example, a non-planar clip which is used to attach the marker to the book in its correct position. Further, whilst in the above embodiments, the marker is formed of just one element, it is possible that the marker could be made from two or more elements connected together; e.g. one laminar element may be used as the abutment means whilst another laminar element may include the arm and page retaining element; and/or the arm and page retaining element may be formed of separate laminar elements which are attached to each other. Where the arm and page retaining element are be formed of separate laminar elements are attached together, they are preferably solidly connected, for example by means of adhesive bonding or heat bonding. However, where the arm and the abutment means are formed of separate elements they may they are preferably solidly connected, for example by means of adhesive bonding or heat bonding, but alternatively may be connected together by other attachment methods, such as snap-fitting and/or interlocking engagement. The page retaining element of the releasable page holder may be free, i.e. unattached to anything other than the flexible element of the releasable page holder, or may be attached to a further element, for example a further flexible element.

Note in relation to the above that the main body of the bookmark, referred to above in the folded embodiments of bookmark as clip part 41*a*, which is typically inserted between the back page of the book and the back cover of the book, is often referred to as a clip part 41*a*—however it should be understood that this laminar element 41*a* may have various functions, as described, and the magnets may be, as described, applied to this laminar element to form a clip. The laminar element also provides other functions, including the function of providing support, and attachments means, for first end of the flexible arm, and holding the first end of the flexible arm in place when the laminar element is held between the back page of the book and the back cover of the book.

It should be understood that the present disclosure is for the purpose of illustration only and the invention extends to modifications, variations and improvements thereto, and that any features described of the different embodiments may be combined to form further embodiments of the invention. In particular, whilst embodiments of the invention have been described in relation to paperback books, a bookmark according to an embodiment of the invention can be utilized in hardback books: in use, the pair of clip parts 21 would most conveniently be located either side of a set of one or more pages, preferably selected from pages located towards the back of the book. In this way the bookmark, or more specifically the line of abutment 25, is aligned with the top, or bottom, of the pages of the book, enabling the bookmark to operate as described above.

Note that the features, dimensions, operating modes and other characteristics described or shown in the Figures in relation to any embodiment described above should be understood also to apply in relation to other embodiments, unless they are clearly incompatible due to a difference in features, dimensions, operating modes which is otherwise described or shown in the Figures. It should be further understood that measurements, both absolute and relative, can be taken from the figures, to provide additional information about the features described above in relation to the embodiments of the invention.

The invention claimed is:

1. A bookmark for marking pages in a book having a spine and a plurality of laminar book parts attached to the spine, the laminar book parts including front and back covers and a plurality of pages, each laminar book part being planar and having edges including a top, a bottom, a free side edge, and an attached side edge attached at the spine of the book, the bookmark comprising:

a laminar element for insertion between laminar book parts;

a magnetic clip which provides attractive clipping force through a laminar book part for gripping the laminar book part; and a releasable page holder, the magnetic clip being arranged to define at least one abutment area in which the bookmark abuts against the laminar book part, the at least one abutment area defining a line of abutment along which an edge of the laminar book part is to be aligned when the bookmark is abutted against the laminar book part, the releasable page holder comprising a flexible element and a page retaining element, the flexible element being attached, at a first end, to the laminar element and, at a second end, to the page retaining element, wherein the first end of the flexible element is arranged to be located adjacent an edge of the laminar book part and the flexible element is arranged to extend from the first end along an edge of the laminar book part when the bookmark is abutted against an edge of the laminar book part, wherein the second end of the flexible element is arranged to be movable with respect to the first end by means of flexing of the flexible element away from the laminar book part towards the second end of the flexible element, to enable the page retaining element to engage and retain the page whilst the bookmark is held in place on the laminar book part by the magnetic clip, and wherein said one abutment area is spaced from the first end of the flexible element via the laminar element, the second end of the flexible element being disposed between the first end of the flexible element and the abutment area as measured along the line of abutment.

2. A bookmark according to claim 1, wherein the magnetic clip comprises a pair of magnetic parts mutually attached via the abutment area.

3. A bookmark according to claim 1, wherein the bookmark comprises a hinge part and wherein the abutment area comprises the hinge part.

4. A bookmark according to claim 1, the abutment line having a first side and a second side, the flexible element being arranged on the second side of the line of abutment and the page retaining element being arranged on the first side of the line of abutment, the flexible element including an inner edge and an outer edge, wherein the inner edge is closer than the outer edge to the line of abutment, the first and second ends of the flexible element being separated with respect to each other along the line of abutment by an end separation distance of at least 1 cm.

5. A bookmark according to claim 4, wherein the end separation distance of the flexible element is between 3 cm and 9 cm.

6. A bookmark according to claim 5, wherein the end separation distance of the flexible element is between 5 cm and 7 cm.

7. A bookmark according to claim 4, wherein the page retaining element extends from the line of abutment by an extension distance of at least 1 cm.

8. A bookmark according to claim 7, wherein the extension distance is less than 3 cm.

9. A bookmark according to claim 1, wherein the at least one abutment area is arranged relative to the flexible element, along the line of abutment, to one side of the flexible element.

10. A bookmark according to claim 9, wherein the at least one abutment area consists of a single abutment area arranged to one side of the flexible element.

11. A bookmark according to claim 9, wherein the at least one abutment area has a total width, measured along the line of abutment, of at least 2 cm.

12. A bookmark according to claim 11, wherein the at least one abutment area has a total width, measured along the line of abutment, of less than 7 cm.

13. A bookmark according to claim 1, wherein the laminar element and the flexible element of the bookmark are formed from cut sheet material.

14. A bookmark according to claim 13, wherein the laminar element and the flexible element of the bookmark are unitarily formed from a single cut sheet material blank.

15. A bookmark according to claim 1, wherein the flexible element is formed of laminar material and has an average width, measured perpendicular to the line of abutment, between the first and second ends, of at least 3 mm.

16. A bookmark according to claim 1, wherein the flexible element is an elongate, rounded element.

17. A bookmark according to claim 1, wherein the laminar element, the abutment area and the releasable page holder are formed as a unitary piece from cut and folded sheet material.

18. A bookmark according to claim 17, wherein the page retaining element is formed from laminar material and the average width of the page retaining element, measured parallel to the line of abutment, is less than 1.5 cm.

19. A bookmark according to claim 18, wherein the maximum width of the page retaining element, measured parallel to the line of abutment, is less than 1.5 cm.

20. A bookmark according to claim 1, wherein the page retaining element comprises a page retaining edge, facing the first end of the flexible element, at least part of which is angled such that an angle between said edge of the laminar book part and the line of abutment is less than 90°, when measured from the side of the first end of the flexible element.

21. A bookmark according to claim 20, wherein said angle is between 60° and 80°.

22. A bookmark according to claim 20, wherein the page retaining edge is shaped such that a variable angle is provided between the page retaining edge and the line of abutment along a length of the page retaining edge, said variable angle decreasing, when measured from the side of the first end of the flexible element, as the page retaining edge extends away from the line of abutment.

23. A bookmark according to claim 22, wherein the page retaining edge is rounded.

24. A bookmark according to claim 1, wherein the width of said first end, measured parallel to the line of abutment, is less than 3 cm.

25. A bookmark according to claim 24, wherein the width of said first end, measured parallel to the line of abutment, is less than 2 cm.

26. A bookmark according to claim 1, wherein the width of said second end, measured parallel to the line of abutment, is less than 1.5 cm.

27. A bookmark according to claim 26, wherein the width of said second end, measured parallel to the line of abutment, is less than 1 cm.

28. A bookmark according to claim 1, wherein the width of said bookmark, measured parallel to the line of abutment, is less than 16 cm.

29. A bookmark according to claim 1, wherein the width of said bookmark, measured parallel to the line of abutment, is more than 7 cm.

30. A bookmark according to claim 1, wherein the width of said bookmark, measured parallel to the line of abutment, is between 9 cm and 13 cm.

31. A bookmark according to claim 1, wherein the width of said bookmark, measured parallel to the line of abutment, is between 10 cm and 12 cm.

32. A bookmark according to claim 1, wherein said flexible element is formed of a laminar material having a thickness of less than 1.5 mm.

33. A bookmark according to claim 32, wherein said flexible element is formed of a laminar material having a thickness of less than 1 mm.

* * * * *